United States Patent [19]

Buford et al.

[11] Patent Number: 4,670,194

[45] Date of Patent: Jun. 2, 1987

[54] CARBURETOR

[76] Inventors: Wesley E. Buford, 716 N. Grand, Covina, Calif. 91723; Charles G. Buford, 4566 Quailridge Dr., Oceanside, Calif. 92056

[21] Appl. No.: 789,625

[22] Filed: Oct. 21, 1985

[51] Int. Cl.[4] ..... F02M 7/26

[52] U.S. Cl. ..... 261/36.2; 261/52; 261/443; 261/121.2; 261/63; 261/69.2; 261/48; 261/39.5; 261/DIG. 39

[58] Field of Search ..... 261/36 A, 52, 44 B, 261/DIG. 39, 121 A, 63, 69 A, 48, 39 D, 50 R

[56] References Cited

U.S. PATENT DOCUMENTS

| | | | |
|---|---|---|---|
| 1,616,726 | 2/1927 | Wilcox | 261/41 B |
| 1,927,090 | 9/1933 | Hess | 261/DIG. 39 |
| 2,152,057 | 3/1939 | Killmeyer | 261/DIG. 39 |
| 2,225,261 | 12/1940 | Jorgensen | 261/39 D |
| 2,833,261 | 5/1958 | August | 261/63 |
| 3,023,745 | 3/1962 | Bames | 261/63 |
| 3,039,485 | 6/1962 | Brohl | 261/36 A |
| 3,249,344 | 5/1966 | Smith | 261/69 R |
| 3,266,785 | 8/1966 | Kennedy, Sr. | 261/50 R |
| 3,933,952 | 1/1976 | Elmore | 261/50 R |
| 3,957,930 | 5/1976 | Birmingham | 261/44 B |
| 3,965,221 | 6/1976 | Englert et al. | 261/36 A |
| 4,132,203 | 1/1979 | Elpern et al. | 261/36 A |
| 4,137,284 | 1/1979 | Barbee | 261/44 B |
| 4,206,735 | 6/1980 | Miles et al. | 261/36 A |
| 4,224,904 | 9/1980 | Clerk | 261/DIG. 39 |
| 4,434,110 | 2/1984 | Highfield | 261/36 A |
| 4,515,734 | 5/1985 | Rock et al. | 261/121 A |

FOREIGN PATENT DOCUMENTS

| | | | |
|---|---|---|---|
| 2559157 | 8/1976 | Fed. Rep. of Germany | 261/36 A |
| 123360 | 2/1919 | United Kingdom | 261/63 |

*Primary Examiner*—Tim Miles

*Attorney, Agent, or Firm*—William P. Green

[57] ABSTRACT

A carburetor including a fuel inlet and first air inlet delivering fuel and air to a location at which they are intermixed, and from which they flow toward an outlet of the device, with additional air being introduced into the stream through a second air inlet at a location downstream of the fuel inlet and the first air inlet. A fuel metering valve may deliver fuel to the fuel inlet in precisely measured fashion, with the fuel being supplied to the metering valve by a pressure regulator. The second air inlet may include an air valve assembly having sleeves with apertured side walls which are relatively rotatable to vary the rate of delivery of air through that valve assembly. Full vaporization of the fuel may be enhanced by introduction of air into the stream or streams of intermixed fuel and air at other locations along a circuitous path or paths followed by the fuel air mixture. The mixture may be directed through tapering passages acting to increase the velocity of the mixture to a maximum velocity point at which some of the additional air is injected laterally into the stream. Automatic control mechanism responsive to engine vacuum and to a temperature actuated element functions to maintain the pressure of the fuel delivered to a fairly high value during starting of the engine and until it reaches a predetermined operating temperature, at which time the pressure automatically reduces to a lower operating value.

30 Claims, 37 Drawing Figures

FIG. 1
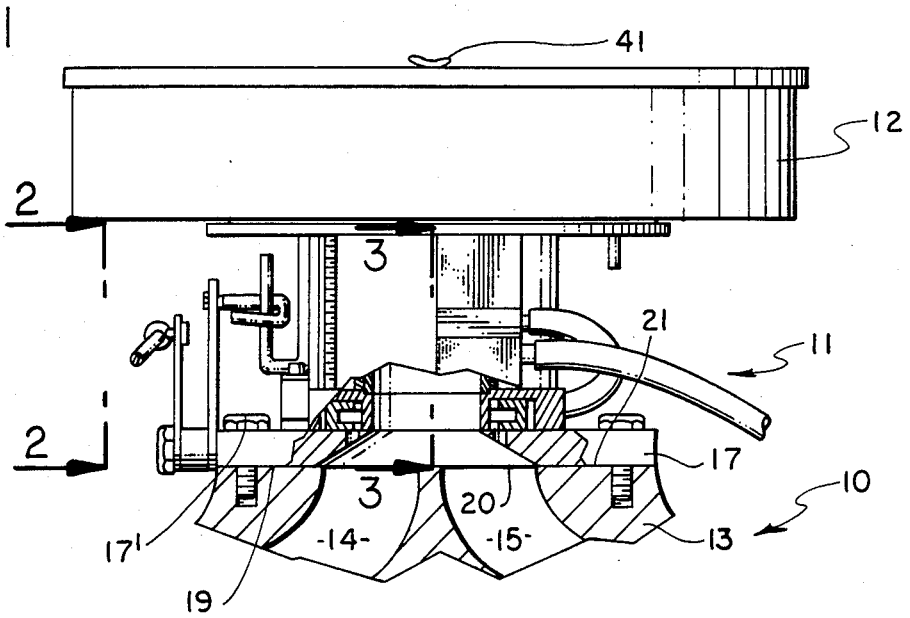
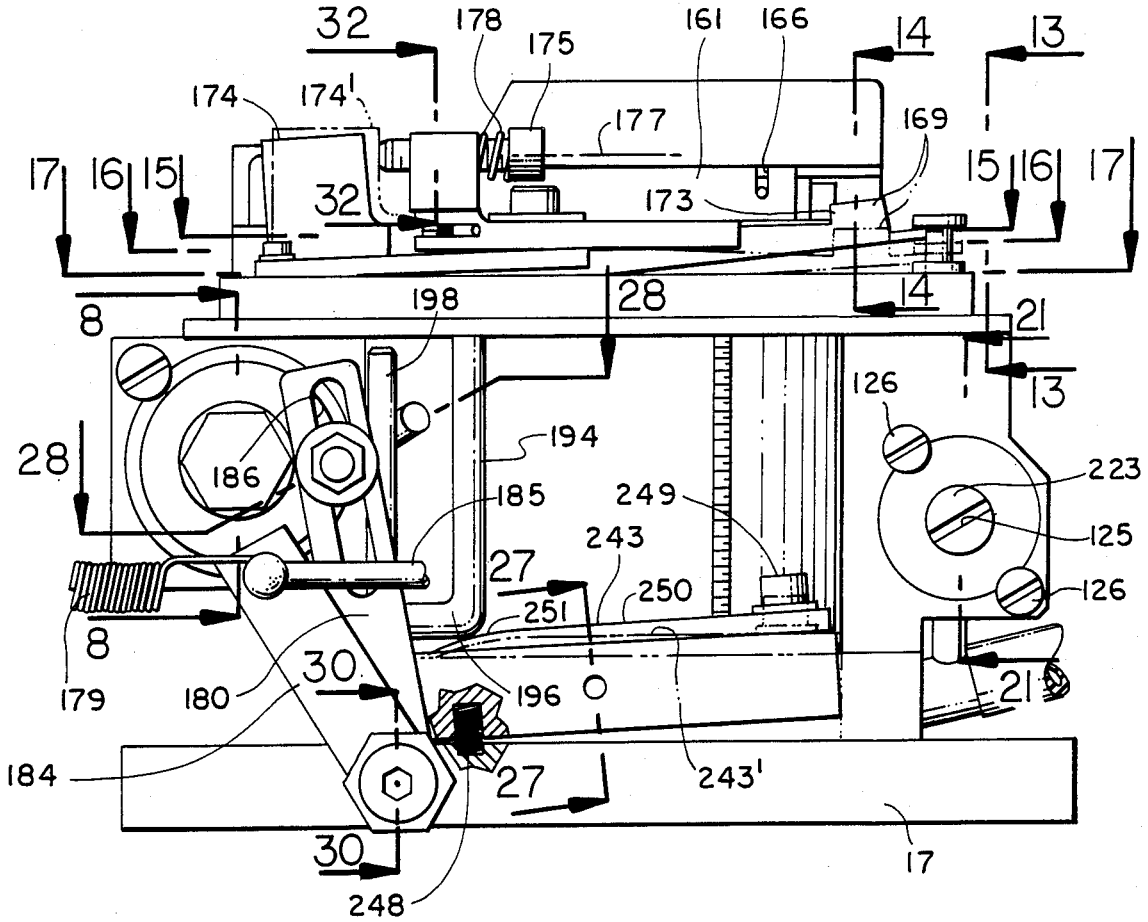
FIG. 2

FIG. 4
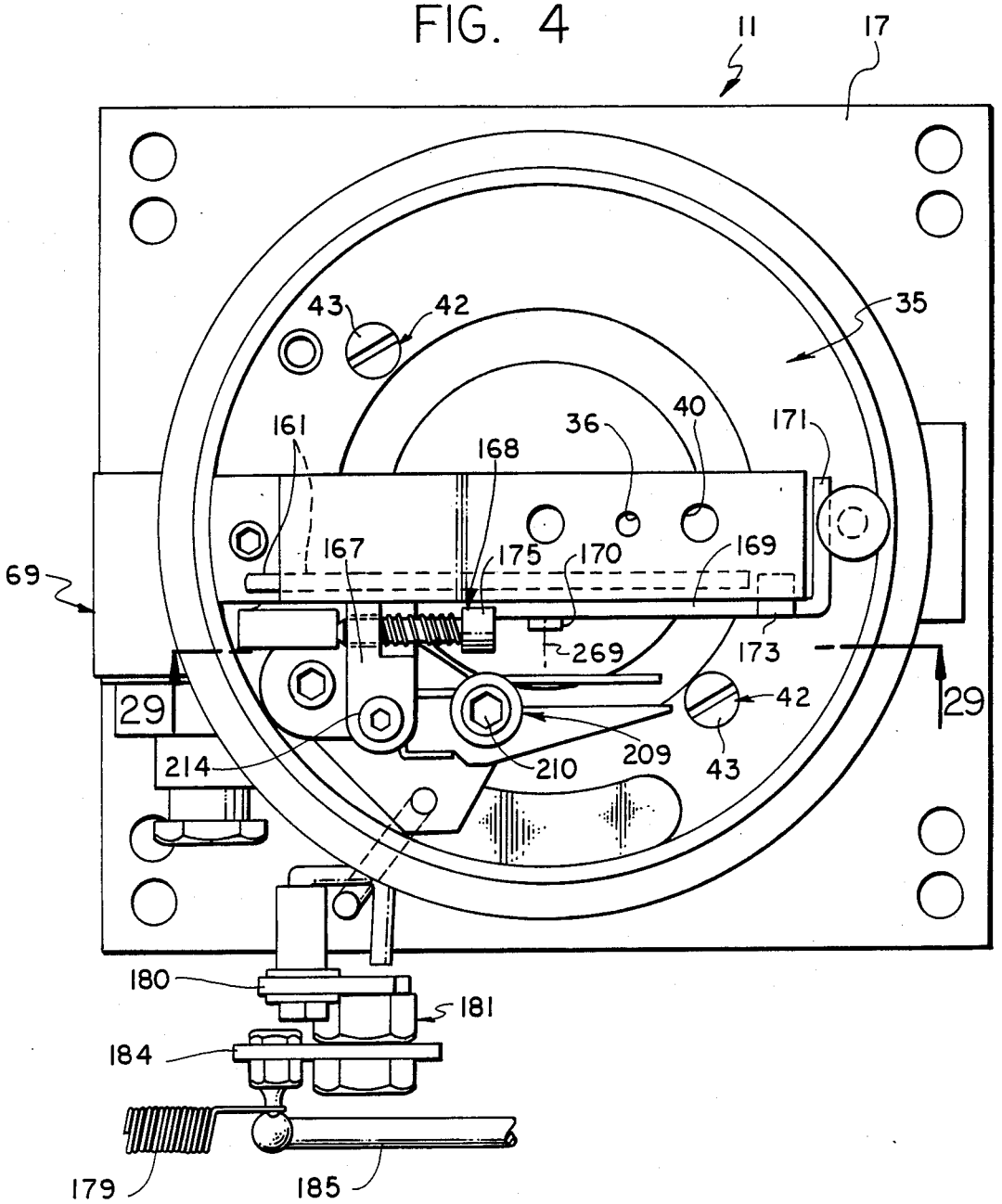
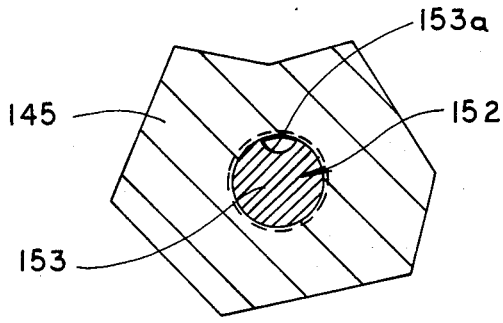
FIG. 6
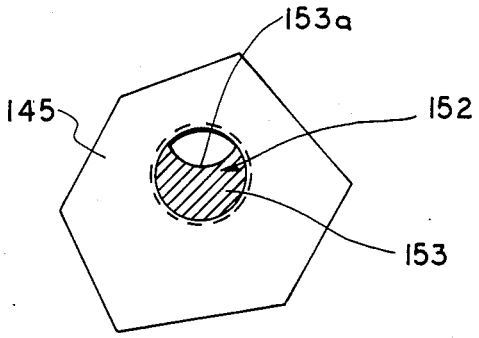
FIG. 7

FIG. 10
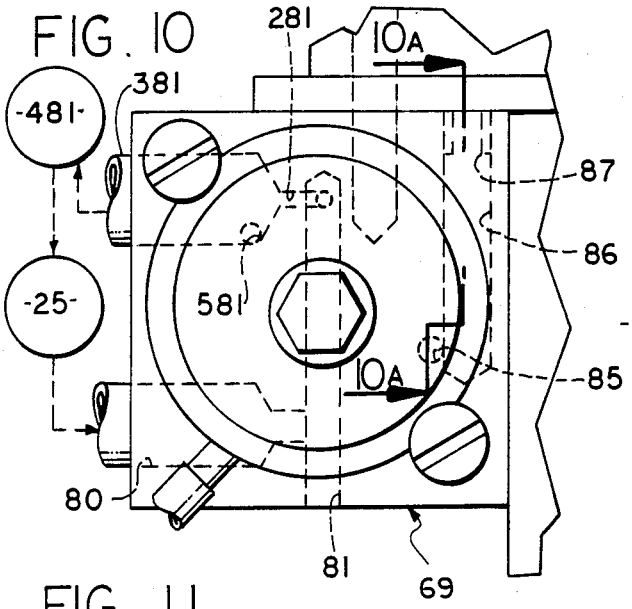
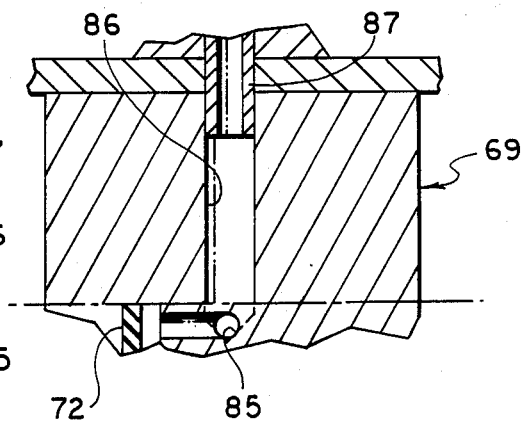
FIG. 10A
FIG. 11
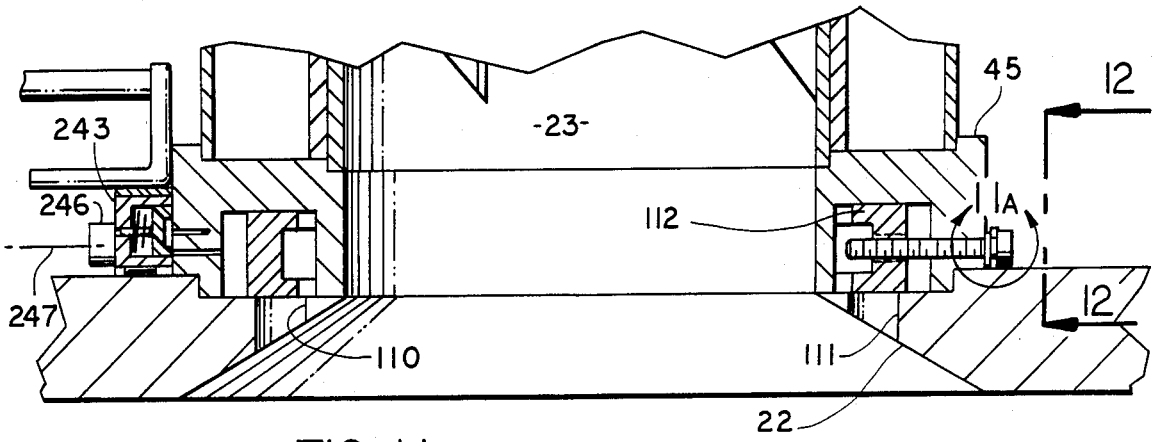
FIG. 11A
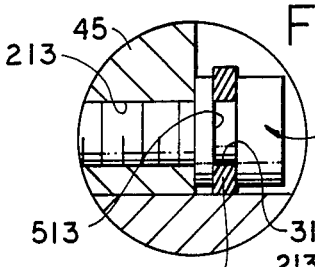
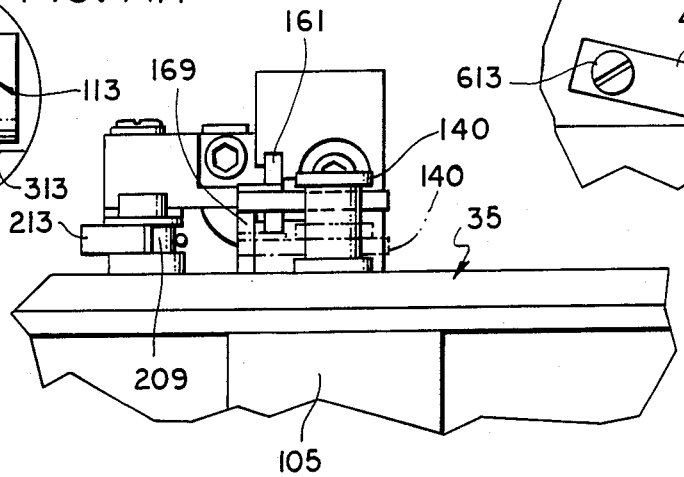
FIG. 13
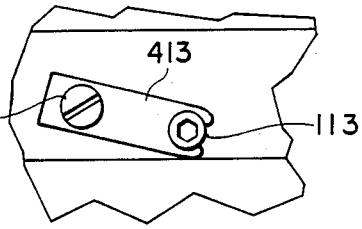
FIG. 12

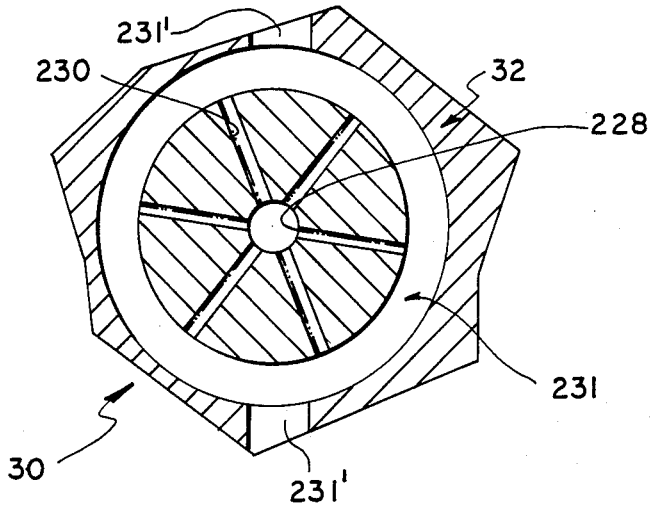
FIG. 24
FIG. 25
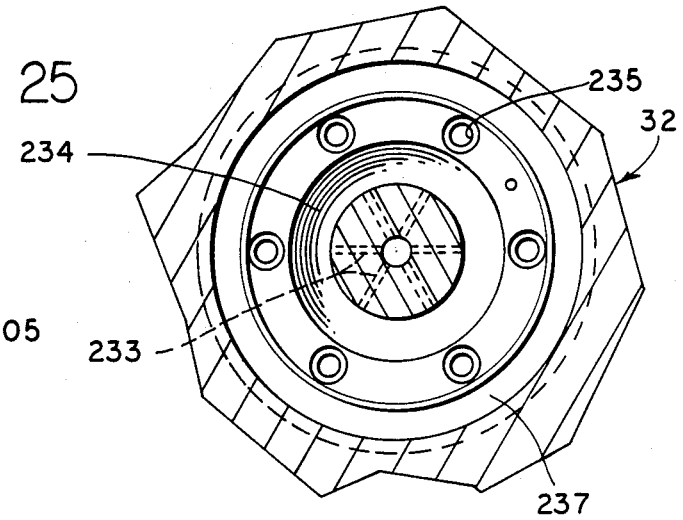
FIG. 26
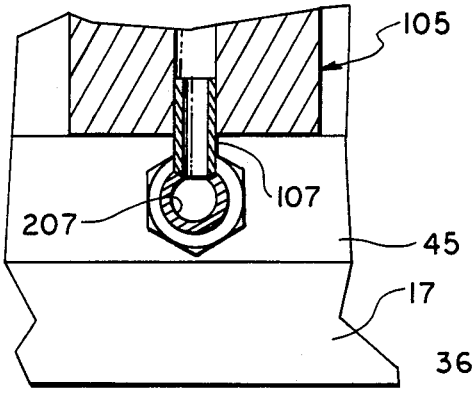
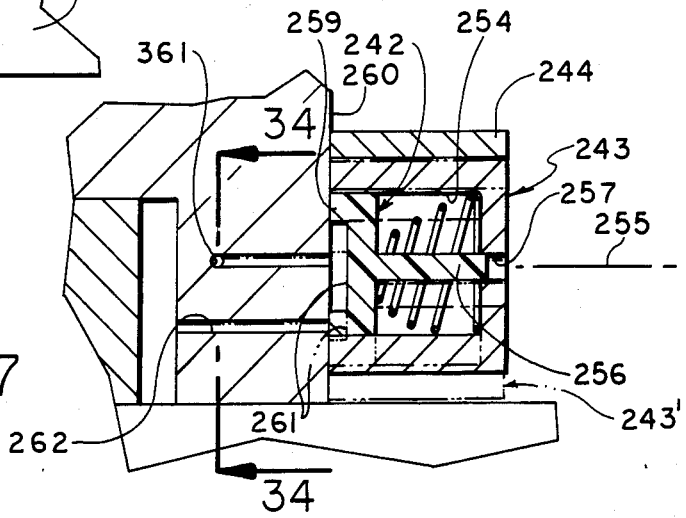
FIG. 27

CARBURETOR

This invention relates to improved carburetors, for mixing fuel and air to be delivered to an engine or other fuel burning unit.

BACKGROUND OF THE INVENTION

The conventional type of carburetor customarily utilized in internal combustion engines includes a butterfly valve or valves actuable by an accelerator pedal to control the flow of air through the carburetor to an intake manifold, with fuel being drawn into the flow of air by suction to form a combustible mixture. Various accessory devices have been added to this basic type of carburetor over the years in an attempt to alter or refine its operation and improve the characteristics of the burnable mixture delivered to the engine, and to compensate for changes in operating conditions such as acceleration, increased load, etc. As a result, carburetors have become very complex intricate mechanisms having a large number of parts containing and defining many critically interrelated flow passages and metering ports and requiring frequent tune-up or repair for satisfactory operation. Further, in spite of this complexity, conventional carburetors do not control and regulate the air-fuel mixture satisfactorily under different operating conditions, and do not vaporize and disperse the fuel as effectively as would be desired. For example, upon acceleration the conventional carburetor injects an essentially unmeasured quantity of fuel into the air stream in a manner not even approximating a proper air-fuel ratio. Other similarly imprecise expedients are employed to meet various other requirements of the engine, with the overall result that very low mileage per gallon of fuel is attained. In addition, improper combustion of the poorly mixed and poorly proportioned fuel and air mixture tends to cause emission by the engine of unburned gases and other pollutants requiring addition of emission control devices to the engine in order to meet antipollution standards set by the Government.

SUMMARY OF THE INVENTION

A major object of the present invention is to provide an improved carburetor which can deliver to an engine or other fuel burning unit a very precisely and reliably proportioned air-fuel mixture, with complete vaporization of the fuel before delivery to the engine, and thorough and uniform dispersal of the fuel throughout the air stream. Further contemplated is a carburetor in which this optimum air-fuel mixture can be maintained over a long period of time, without the necessity for tuning, cleaning or adjusting the carburetor, and without the usual tendency of conventional carburetors for progressive degredation of their operational effectiveness in use.

Structurally a carburetor embodying the invention preferably includes at least two different air inlets, a first of which may introduce a minor amount of air into the carburetor at a location to intermix with fuel flowing through an adjacent fuel inlet, with the second air inlet introducing additional air at a location downstream of the first air inlet. The fuel may be delivered through a metering valve which precisely measures the fuel injected into the air stream, and which desirably receives fuel from a pressure regulator acting to maintain a controlled fuel pressure at the location of the metering valve.

Certain particular features of the invention relate to automatic controls for the pressure regulator, acting to deliver fuel to the metering valve at a relatively high pressure during start-up of the engine and while the engine is cold, and to then convert to a lower pressure operating condition after the engine has been started and has reached a predetermined operating temperature. Control signals may be communicated to the regulator by engine vacuum, in a manner tending to convert the regulator from its higher pressure to its lower pressure condition upon development of a predetermined vacuum by the engine. In order to assure warmup of the engine, temperature responsive means may be provided for preventing communication of the vacuum to the pressure regulator unless the engine has reached a proper operating temperature.

The metering valve may include a longitudinally movable metering rod, which is preferably attached to and actuable by a carrier, and is adjustable relative to the carrier to control the idling mixture. A seal element movable with the carrier may completely close off the flow of all fuel in a closed condition of the metering valve. Also, the inflow of air through the mentioned first air inlet may be automatically increased and decreased by a valving action of the metering rod carrier.

The initial mixture of air and fuel from the fuel inlet and the first air inlet is preferably directed along a non linear path in a manner changing the direction of flow of this mixture abruptly at different locations to further enhance vaporization of the fuel and its dispersal throughout the air stream. Along this circuitous path, the air and fuel mixture may be directed through one or more tapering passages, which act to increase the velocity of the mixture as the cross section of the passages decreases, and then inject additional air into the mixture at the location of maximum velocity. Preferably, the initial mixture first flows through one such tapering passage, with injection of air at the narrowest portion of that passage, and is then broken up into a plurality of streams flowing through a number of additional tapering passages, with injection of further air at the narrowest portions of those passages.

After the fuel and air have been intermixed in this manner, the combined air and fully volatilized fuel may be directed through a final valve assembly which is preferably essentially tubular and has side wall apertures through which the final major portion of the air is injected into the stream. This final valve assembly may include two concentric sleeves disposed one about the other and containing wall apertures which move into and out of registry by rotation of one of the sleeves relative to the other.

The fuel metering valve and main air valve are operated in unison by an accelerator pedal or other accelerator mechanism, including a unique linkage which converts rotary motion of one valve element to linear motion of the other. This linkage may be adjustable to vary the extent of linear movement for a particular number of degrees of rotary movement.

Another feature of the invention relates to an arrangement for preventing movement of the metering valve beyond a predetermined relatively low speed starting condition until the engine is in operation and has developed an operating vacuum. This mechanism thus prevents injection of an excessive amount of fuel into the carburetor during starting, to avoid flooding of the engine. Further, the linkage interconnecting the air and fuel valves may include an override device enabling an operator to open the air valve by actuation of the accelerator pedal beyond the corresponding position of the fuel metering valve when the fuel metering valve is retained against opening beyond its starting position, to thus further allow for purging of the carburetor by an excess of air and additionally assure against development of a flooded condition.

Another feature of the invention relates to a unique mechanism for slightly deflecting the mixture of air and fuel delivered through the outlet of the carburetor, in a manner causing slightly more of the mixture to flow into one of two intake manifolds of the engine than into the other of the manifolds, to thus compensate for slight differences in the demands of the cylinders associated with the two manifolds and attain the best possible overall functioning of the engine. This slight deflection of the output of the carburetor may be attained by provision of valving means acting to admit two streams of air into the main intermixed air and fuel stream at different sides of the outlet of the carburetor, with these two streams being regulatable relative to one another to vary their effect on the principal stream. For this purpose, a ring disposed about the outlet of the carburetor may have portions received in the path of air flowing to each of two small passages at opposite sides of the main carburetor outlet, with the ring being shiftable to vary the extent to which it obstructs the flow through these two openings respectively.

BRIEF DESCRIPTION OF THE DRAWINGS

The above and other features and objects of the invention will be better understood from the following detailed description of the typical embodiments illustrated in the accompanying drawings, in which:

FIG. 1 is a rear view of a carburetor embodying the invention shown attached to the intake manifold structure of a gasoline internal combustion engine, with the lower portion of the carburetor and part of the connected manifold structure being illustrated in vertical section;

FIG. 2 is an enlarged side view of the carburetor taken on line 2—2 of FIG. 1;

FIG. 4 is a plan view taken on line 4—4 of FIG. 3;

FIGS. 6 and 7 are enlarged transverse sections through the fuel metering valve assembly taken on lines 6—6 and 7—7 respectively of FIG. 3;

FIG. 10 is a fragmentary view corresponding to a portion of FIG. 3, and showing certain of the internal passages in the pressure regulator in broken lines;

FIG. 10A is a fragmentary vertical section taken on line 10A—10A of FIG. 10;

FIG. 11 is a fragmentary vertical section taken on line 11—11 of FIG. 3;

FIG. 11A is an enlarged detail view of the portion of FIG. 11 contained in the circle 11A;

FIG. 12 is a fragmentary side view taken on line 12—12 of FIG. 11;

FIG. 13 is a view taken on line 13—13 of FIG. 2;

FIGS. 24 and 25 are fragmentary generally horizontal sections taken on lines 24—24 and 25—25 respectively of FIG. 3;

FIG. 26 is a vertical section on line 26—26 of FIG. 3;

FIG. 27 is an enlarged fragmentary vertical section taken on line 27—27 of FIG. 2;

DESCRIPTION OF THE PREFERRED EMBODIMENTS

Figure 3:
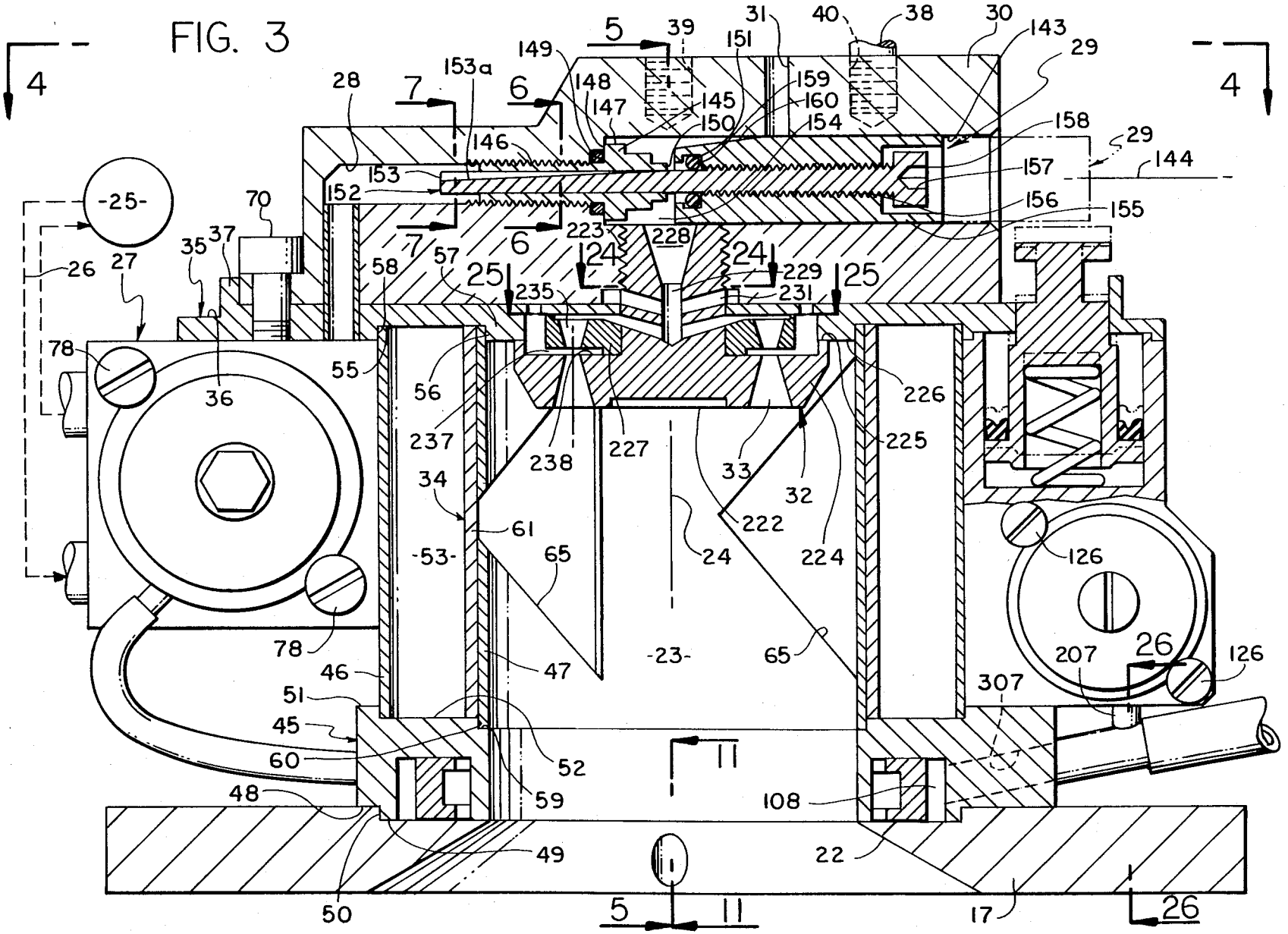
FIG. 3 is an enlarged central vertical section taken primarily on line 3—3 of FIG. 1.

Referring first to FIG. 1, there is illustrated fragmentarily and somewhat diagrammatically in that figure an internal combustion engine 10 adapted to be driven by a liquid fuel, typically gasoline, and including a carburetor 11 embodying the invention connected to the upper side of an air intake manifold 13 containing two intake manifold passages 14 and 15 for conducting an air fuel mixture from the carburetor to different groups of cylinders within the engine block structure. The carburetor may include a rigid horizontally extending base plate 17 preferably formed of metal and having a rectangular horiziontal cross-section (FIG. 4) to be attached to the upper side of the intake manifold structure 13 by four screws 17', with a gasket 19 being received and clamped between the horizontal planar undersurface 20 of the carburetor and the similarly horizontal planar upper surface 21 of the intake manifold. Plate 17 contains a circular preferably downwardly flaring opening 22 of a diameter communicating with both of the intake manifold passages 14 and 15 leading to the cylinders and forming the lower portion of a circular passage 23 extending vertically within carburetor 11 and centered about a vertical axis 24 for delivering the air fuel mixture downwardly to passages 14 and 15.

The gasoline or other liquid fuel to be burned in the engine is delivered to the carburetor from a fuel pump 25 (FIG. 3), which may be the usual cam operated pump or an electrical pump, and which is driven continuously as long as the engine is turning and supplies fuel to a line 26 at a pressure which may vary substantially. This fuel is delivered to a pressure regulator 27 which forms part of the carburetor and acts to deliver the fuel at a more controlled pressure to a passage 28 leading to a fuel metering valve assembly 29 within an upper body part 30 of the carburetor. The fuel discharged by metering valve 29 is initially intermixed with a small amount of air entering body part 30 from the air filter 12 through a passage 31. The intermixed fuel and air is then directed through a system of passages within a fuel dispersal assembly 32 in a manner assuring complete atomization of the fuel and intermixture with the air and with additional air introduced in assembly 32. The intermixed air and fuel flows downwardly from this assembly 32 through a number of flaring downwardly directed circularly spaced passages 33 which discharge the air and fuel into the previously mentioned main passage 23 leading to the intake manifold. A rotary air intake valve assembly 34 is disposed about and defines the periphery of passage 23, and acts to introduce a major quantity of additional air into the downwardly flowing stream of intermixed air and fuel, to reach the ultimate desired air-fuel ratio required by the engine.

Spaced above its bottom plate 17, the carburetor includes a circular horizontally extending top plate 35 (FIG. 3) which is centered about the main vertical axis 24 of the carburetor and has an upwardly facing annular horizontal surface 36 at its periphery on which air filter 12 rests. An upwardly projecting circular flange 37 on plate 35 is engageable with the air filter to center it in conventional manner. A threaded stud 38 can be connected threadedly into either of two threaded passages 39 and 40 in upper body part 30, to project upwardly thereabove for attachment to the usual wing nut 41 or other fastener at the top of the air filter acting to clamp the air filter downwardly against the carburetor.

Figure 5:
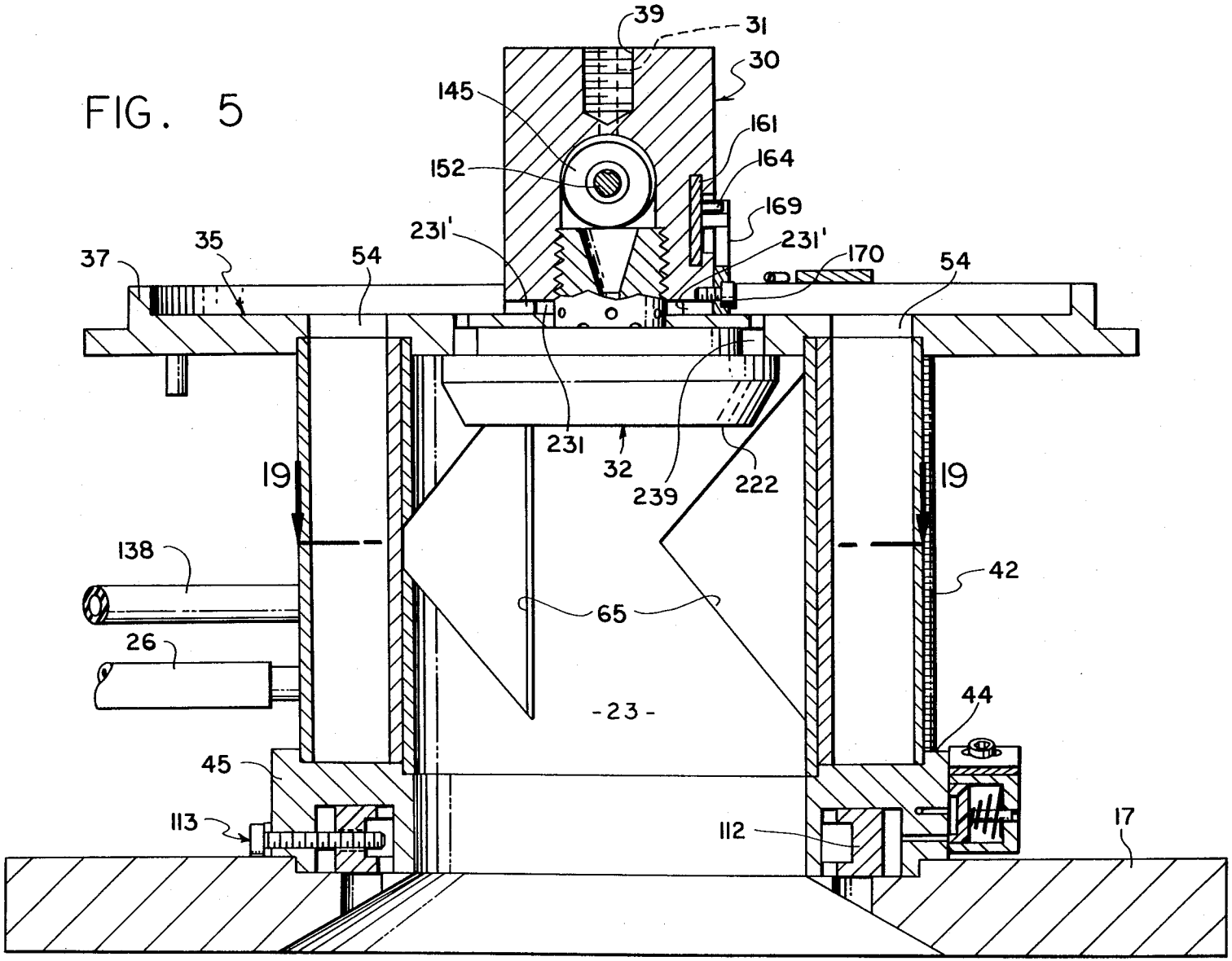
FIG. 5 is a transverse vertical section taken on line 5—5 of FIG. 3.
Figure 15:
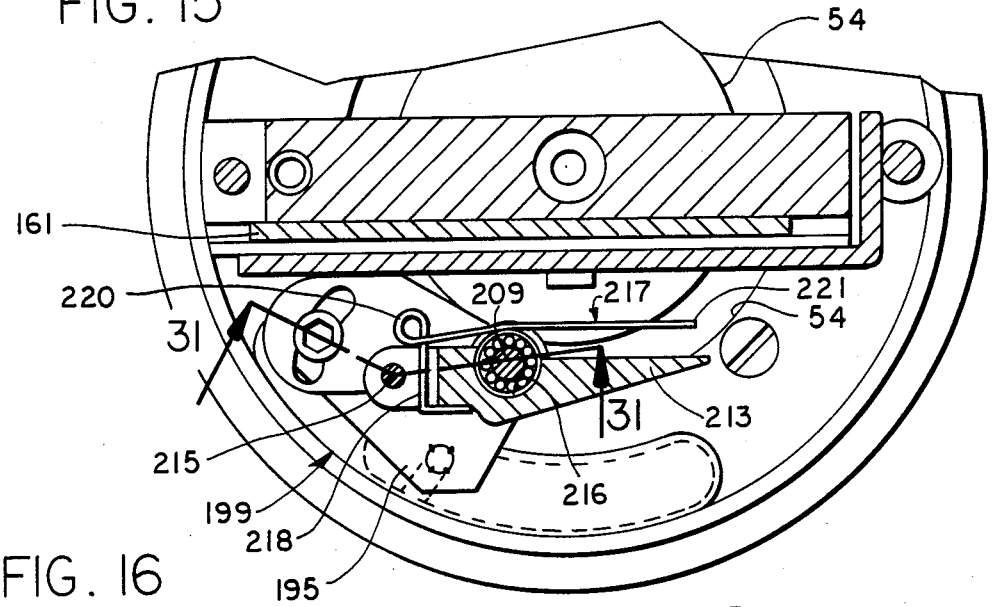
FIGS. 15, 16 and 17 are fragmentary horizontal sections taken on lines 15—15, 16—16 and 17—17, respectively, of FIG. 2.
Figure 16:
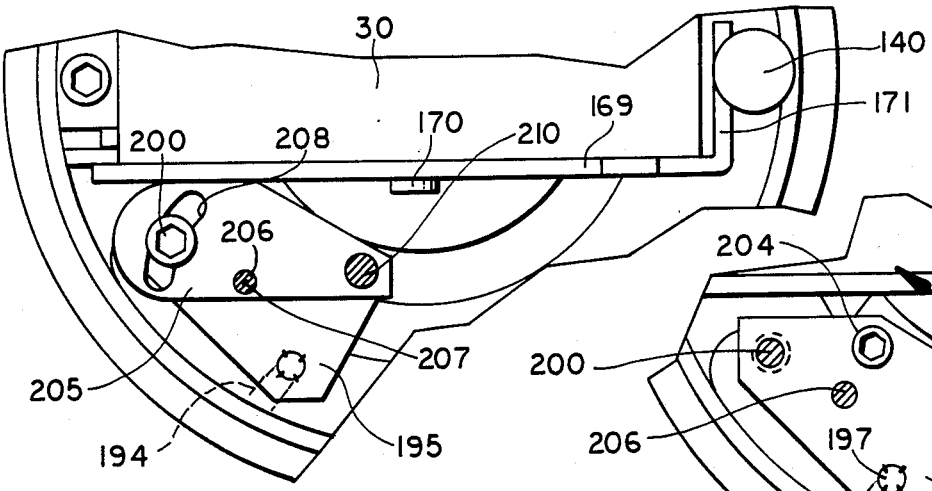

Top plate 35 is secured to base plate 17 by two elongated vertical screws 42 (FIGS. 4 and 5) extending through aligned openings in these parts and having upper heads 43 bearing downwardly against top plate 35, and having lower ends connected threadedly into base plate 17 at 44 (FIG. 5). Two additional body parts 45 and 46 (FIG. 3) are clamped vertically between bottom plate 17 and top plate 35 by tightening of the connecting screws 42, as is an inner cylindrical vertical sleeve 47 of air valve assembly 34. Body part 45 may take the form of a block of metal or other rigid material of square horizontal section having an annular surface 48 (FIG. 3) bearing downwardly against the upper surface of base plate 17, and having a portion radially inwardly of surface 48 projecting downwardly beyond the level of that surface to the location of a horizontal undersurface 49 of part 45 engaging a correspondingly horizontal upper surface of the base plate 17. The base plate and member 45 have cylindrical surfaces centered about vertical axis 24 and engaging one another at 50 to effectively locate and center part 45 relative to the base and the other body parts. At its upper side, part 45 has an annular axially extending flange 51, and an upwardly facing surface 52 within the flange against which part 46 is engageable downwardly. Part 46 may be cylindrical about axis 24, to form the outer wall of an annular passage 53 into which air flows downwardly from the air filter through two arcuate openings 54 (FIGS. 5 and 15) formed in top plate 35 and centered about axis 24, with these openings 54 being located at opposite sides of the upper body part 30.

The inner wall of passage 53 is formed by the air intake valve 34, and more particularly includes the vertically extending cylindrical sleeve 47 centered about axis 24 and clamped between the top plate 35 and member 45. At its upper end, sleeve 47 may bear upwardly against a horizontal downwardly facing surface 55 of top plate 35, and may be received about and annularly engage a cylindrical external surface 56 formed on a downwardly projecting annular portion 57 of plate 35. Similarly, the upper extremity of body part 56 may bear upwardly against surface 55, and be received within and located by engagement with a short vertically extending cylindrical surface 58 formed on top plate 35. The lower extremity of sleeve 47 bears downwardly against a horizontal surface on part 45 at 59, and is centered and located by engagement with a cylindrical surface 60 of part 45.

Figure 18:
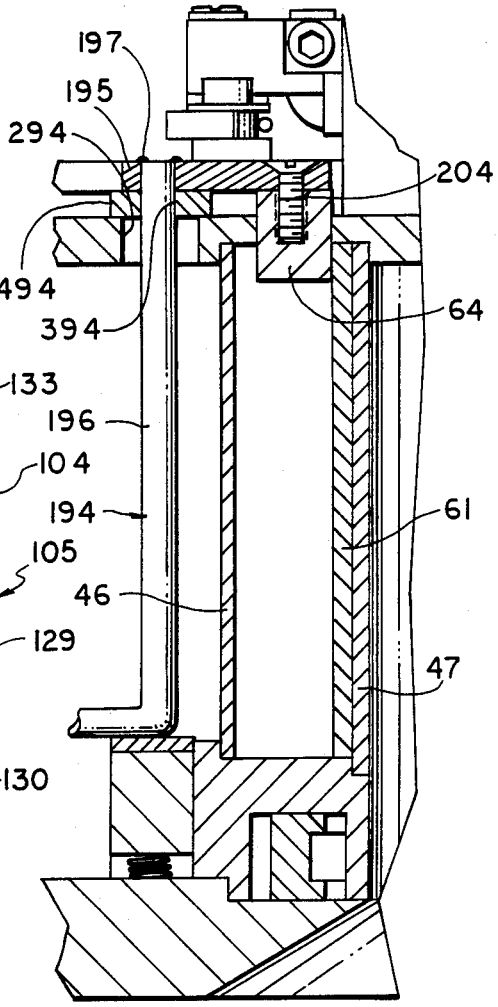
FIG. 18 is a fragmentary vertical section taken on line 18—18 of FIG. 17.

In addition to the sleeve 47 which is clamped vertically between top plate 35 and member 45 and is thus non-rotatable, the air intake valve assembly 34 also includes a second vertically extending sleeve 61 centered about axis 24 and received about and rotatable relative to inner sleeve 47. Sleeve 61 rigidly carries a flange or projection 64 at its upper end which extends arcuately about axis 24 and projects radially outwardly (FIG. 18). This member 64 may be welded to sleeve 61, and is connected to an actuating mechanism which will be described at a later point.

Figure 19:
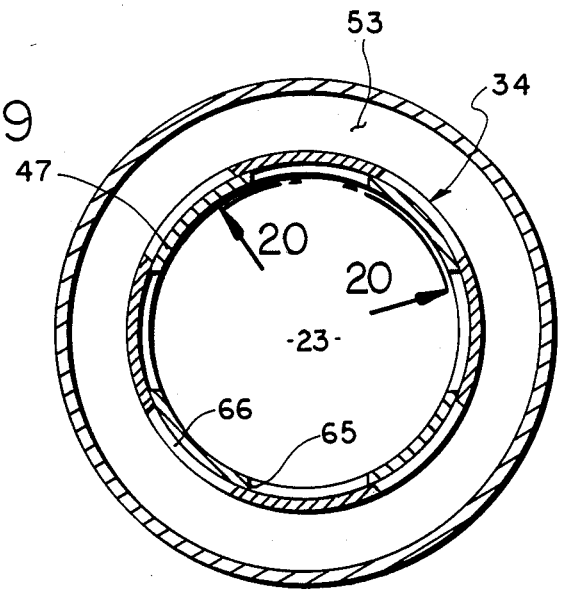
FIG. 19 is a horizontal section on line 19—19 of FIG. 5.
Figure 20:
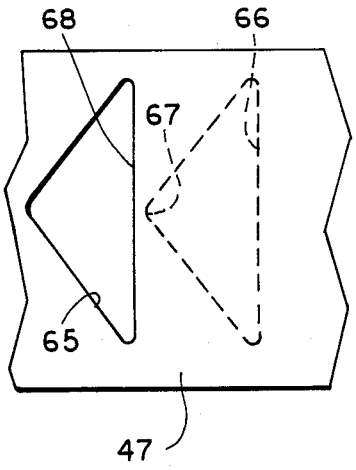
FIG. 20 is a developed view taken on line 20—20 of FIG. 19.

Sleeve 47 contains a series of air apertures 65 which may be spaced uniformly about axis 24 and may have the triangular configuration illustrated in FIG. 20. The outer sleeve 61 of the air valve assembly contains a similar series of circularly spaced side wall apertures 66, which may have the same configuration as apertures 65, and are adapted to register to different extents with those apertures 65 in different rotary positions of sleeve 61, to vary the air passing area of valve assembly 34. In the position of sleeve 61 represented in FIGS. 19 and 20, the apertures 66 of sleeve 61 are completely out of registry with apertures 65 of sleeve 47, so that no air can flow radially inwardly from passage 53 through valve assembly 34 into the inner downflow passage 23. As sleeve 61 is rotated in a counterclockwise direction in FIG. 19, the apex 67 of each aperture 66 moves past the straight vertical edge 68 of a corresponding one of the openings 65 in sleeve 47, to open a small air passage at each apex through which the air may flow from the exterior to the interior of air valve assembly 34. As the rotation of sleeve 61 continues, the portion of each aperture 66 which registers with the corresponding aperture 65 progressively increases, to thus progressivley increase the rate of air flow inwardly through valve assembly 35 up to a fully opened position of the valve assembly in which the apertures of sleeve 61 are in full registry with the apertures of sleeve 47.

Figure 8:
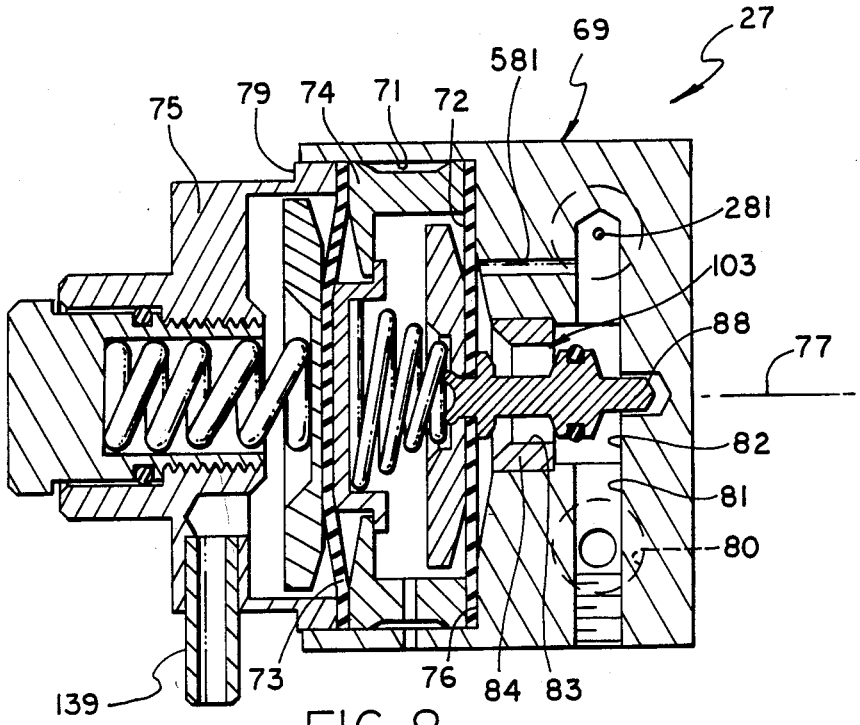
FIG. 8 is a vertical section taken on line 8—8 of FIG. 2.
Figure 9:
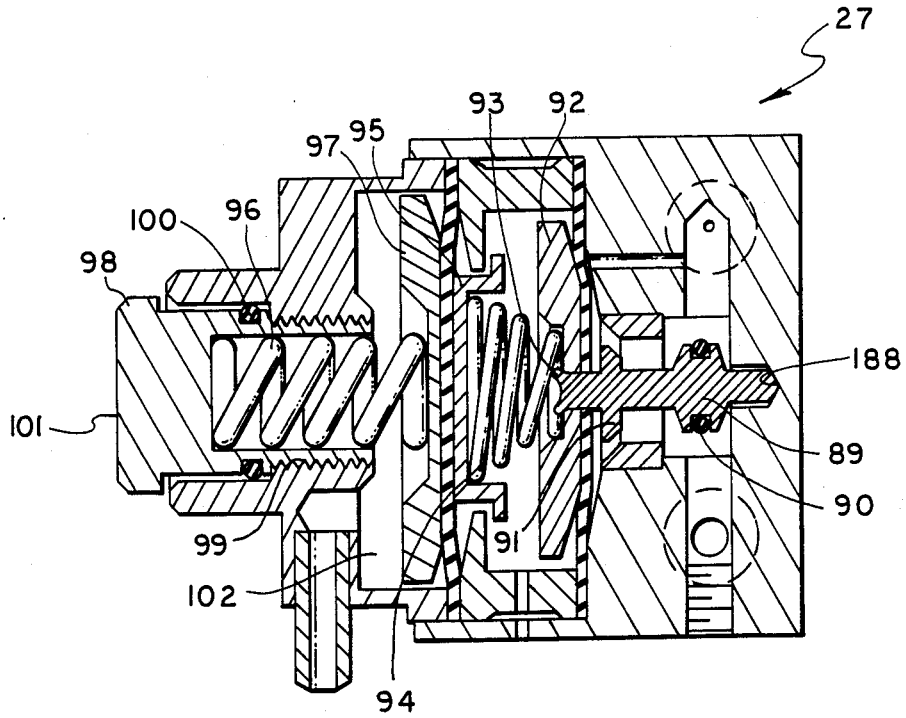
FIG. 9 is a view similar to FIG. 8, but showing the regulator in its cold start condition.

Referring now to FIGS. 8 and 9, the pressure regulator 27 includes a housing block 69 which may be secured rigidly to the underside of top plate 35 at one side of the vertical body part 46 by a screw 70 (FIG. 3), whose head may bear downwardly against an end portion of upper body part 30, with the shank of the screw extending downwardly through that body part and through an opening in top plate 35 for threaded connection into block 69 to secure these parts together. Block 69 contains a cylindrical counterbore or recess 71 within which two flexible imperforate circular diaphragms 72 and 73 are received, with the peripheries of these diaphragms being spaced apart by a rigid annular member 74, and with a circular cap 75 being received within the outer end portion of counterbore 71 to clamp the peripheries of the diaphragms and member 74 tightly axially together and against an annular shoulder 76 formed in block 69 and disposed transversely of a central axis 77 of the diaphragms and other parts of the regulating valve. Cap 75 may be retained in position in any convenient manner, as by provision of two screws 78 (FIG. 3) which are connected threadedly into block 69 and whose heads bear against an annular peripheral flange surface 79 on cap 75 at diametrically opposite locations to tighten the cap and retained parts rightwardly as viewed in FIGS. 8 and 9. This clamping engagement thus forms annular seals at the peripheries of the two diaphragms.

The fuel inlet line 26 (FIG. 3) delivers fuel into a passage 80 in block 69, to flow upwardly through a communicating passage 81 to a circular chamber 82, from which the fuel flows leftwardly in FIG. 8 through a cylindrical passage 83 in a valve sleeve 84 secured rigidly in block 69. Excess fuel and any vapors or air in the regulator are vented from the upper end of passage 81 through a passage 281 and line 381 (FIG. 10) back to the fuel tank 48' from which pump 25 takes suction. To the left of sleeve 84 as viewed in FIG. 8, the fuel is in contact with diaphragm 72, and ultimately discharges from the space to the right side of the diaphragm through a passage 85 (FIG. 10) formed in block 69 to the right of diaphragm 72 and communicating with an upwardly extending passage 86 leading through a sleeve 87 to the previously mentioned passage 28 in upper body part 30 at the inlet side of the fuel metering valve. Any vapor or air which may accumulate in the space to the right of diaphragm 72 in FIG. 8 and to the left of sleeve 84 is vented from the upper part of that space through a passage 581 to return line 381. A pressure regulator valve element 88 is connected to the center of diaphragm 72 to be actuable thereby in opposite directions along axis 77. This element 88 is centered about axis 77, and has an enlargement 89 carrying seal ring 90 forming an annular metering gap between this seal ring and the right end of sleeve 84. At its left end, element 88 may have a flange 91 bearing leftwardly against a central portion of diaphragm 72, with a reduced shank of the valve element 88 projecting leftwardly through an opening in the diaphragm and through an opening in a circular plate 92 at the left side of the diaphragm between flange 91 and plate 92 in a manner forming an effective fluid tight seal at the center of the diaphragm and attaching the valve element to the diaphragm for axial movement thereby. The central portion of diaphragm 72 is yieldingly urged rightwardly by a spiral spring 94, which bears at its left end against a circular element 95 applying force leftwardly to the second diaphragm 73. A second spring 96 bears rightwardly against diaphragm 73 through a circular plate 97. The force of spring 96 is taken by a plug 98 which is threadedly connected at 99 into cap 75, and is sealed with respect thereto by an annular O-ring 100. Plug 98 has a non-circular head 101 engageable by a wrench or other adjusting tool to threadedly adjust the plug leftwardly or rightwardly along axis 77 relative to cap 75 and the other parts, to thus vary the rightward force exerted by spring 96. The left side of diaphragm 73 is exposed to a chamber 102 to which engine vacuum is communicated when the engine is operating and after it has warmed up to a proper running temperature.

Before development of the vacuum in chamber 102, the combined force of springs 94 and 96 is great enough to urge diaphragm 72 and the connected valve element 88 rightwardly to the position represented in FIG. 9, in which the end of element 88 engages body 69 at 188 to limit the rightward movement of the parts. In that condition, the valve element 88 is far enough away from sleeve 84 to leave a relatively wide fuel flow gap at 103 between these parts tending to develop a higher than normal fuel pressure at the right side of diaphragm 72. The regulator responds to variations in fuel pressure from pump 25 to automatically maintain the desired higher than normal pressure at the right side of diaphragm 72 and thus in the communicating passage 28 of FIG. 3. After the engine has been placed in operation and has reached a proper operating temperature, the resultant vacuum communicated to chamber 102 at the left side of diaphragm 73 of FIG. 8 partially overcomes the rightward force of springs 94 and 96, to thus shift diaphragm 72 and the connected valve element 88 leftwardly to the position of FIG. 8 in which the width of annular gap 103 is reduced, and the pressure maintained by diaphragm 72 in passage 28 of FIG. 3 is correspondingly reduced.

Preferably, the pressure maintained in passage 28 by the regulator before warmup of the engine (FIG. 9) is about four pounds per square inch, while the pressure maintained in that passage after startup and after warmup (FIG. 8 condition) may be two pounds per square inch. Also, in each of these conditions, the regulator automatically responds to variations in fuel input pressure to compensate for those variations and maintain an essentially uniform fuel pressure at metering valve 29. Further, the illustrated arrangement functions to automatically respond to variations in engine vacuum resulting from acceleration of the engine, increased load, or the like, to supply increased fuel to the engine when acceleration or load demands that increased fuel. This result is atttained because any reduction in the amount of engine vacuum caused by acceleration or a rise in load is communicated to the chamber 102, with a corresponding reduction in the amount of leftward biasing force exerted on diaphragm 73 by the vacuum, and with corresponding rightward movement of both of the diaphragms and element 88 in proportion to the amount of reduction of the vacuum.

The vacuum is communicated to chamber 102 of the pressure regulator of FIGS. 8 and 9 through a block 104 of a cold start unit 105 (FIGS. 3, 21, 22 and 23) which is rigidly secured to the underside of top plate 35 of the carburetor, as by a screw or screws. At its lower end, block 104 contains a passage 109 connected by a short tube 107 and connecting tubular fitting 207 into a passage 307 leading to chamber 108 formed in the underside of member 45. The chamber 108 (FIG. 3) is in turn placed in communication with the inner fuel and air flow passage 23 in the lower portion of the carburetor through two openings 110 and 111 (FIG. 11) extending downwardly and opening at their lower ends into the conical portion 22 of bottom plate 17. A valve ring 112 which is annular essentially about axis 24 and has the axial sectional configuration illustrated in FIGS. 3, 5 and 11 is received within chamber 108 in part 45, and is shiftable therein leftwardly and rightwardly as viewed in FIGS. 5 and 11 to vary the extent to which this ring closes off each of the two vacuum openings 110 and 111, so that by leftward movement of the ring as viewed in FIG. 5 the amount of air drawn downwardly through passage 111 increases while the amount of air drawn through passage 110 decreases, and similarly by rightward movement of the ring the reverse occurs.

In this way, the amount of air drawn downwardly through one of the openings can be increased relative to the other opening, and the result is that the opening with the greater flow of air tends to deflect the main flow of intermixed fuel and air slightly laterally toward the opposite side of the carburetor, to cause more of that air and fuel mixture to enter one of the passages 14 or 15 of the intake manifold structure than the other passage. The position of the ring is adjusted in this way to compensate for imperfections in the engine which require more air and fuel in one manifold than the other, as occurs in almost all engines, and to attain an optimum balanced operating condition of the engine. The flow deflecting effect is enhanced by the fact that the air drawn downwardly through passages 110 and 111 is heated air from the PC valve, valve cover and crankcase of the engine, as will appear from later portions of this description. The lateral shifting movement of the ring may be attained by an adjusting screw as represented at 113 in FIG. 5, with this screw extendino through an unthreaded bore 213 in member 45 and being threadedly connected into member 112, and being retained against axial movement by engagement of an arcuately curved end edge 313 of an element 413 (FIGS. 11, 11A and 12) within an annular groove 513 in the head of screw 113. Element 213 may be secured to member 45 by a screw 613 (FIG. 12). When screw 113 is turned by an allen wrench or other tool, while the screw is retained by part 413 against axial movement, the rotation of the screw acts by virtue of its threaded engagement with ring 112 to shift that ring rightwardly or leftwardly.

Figure 21:
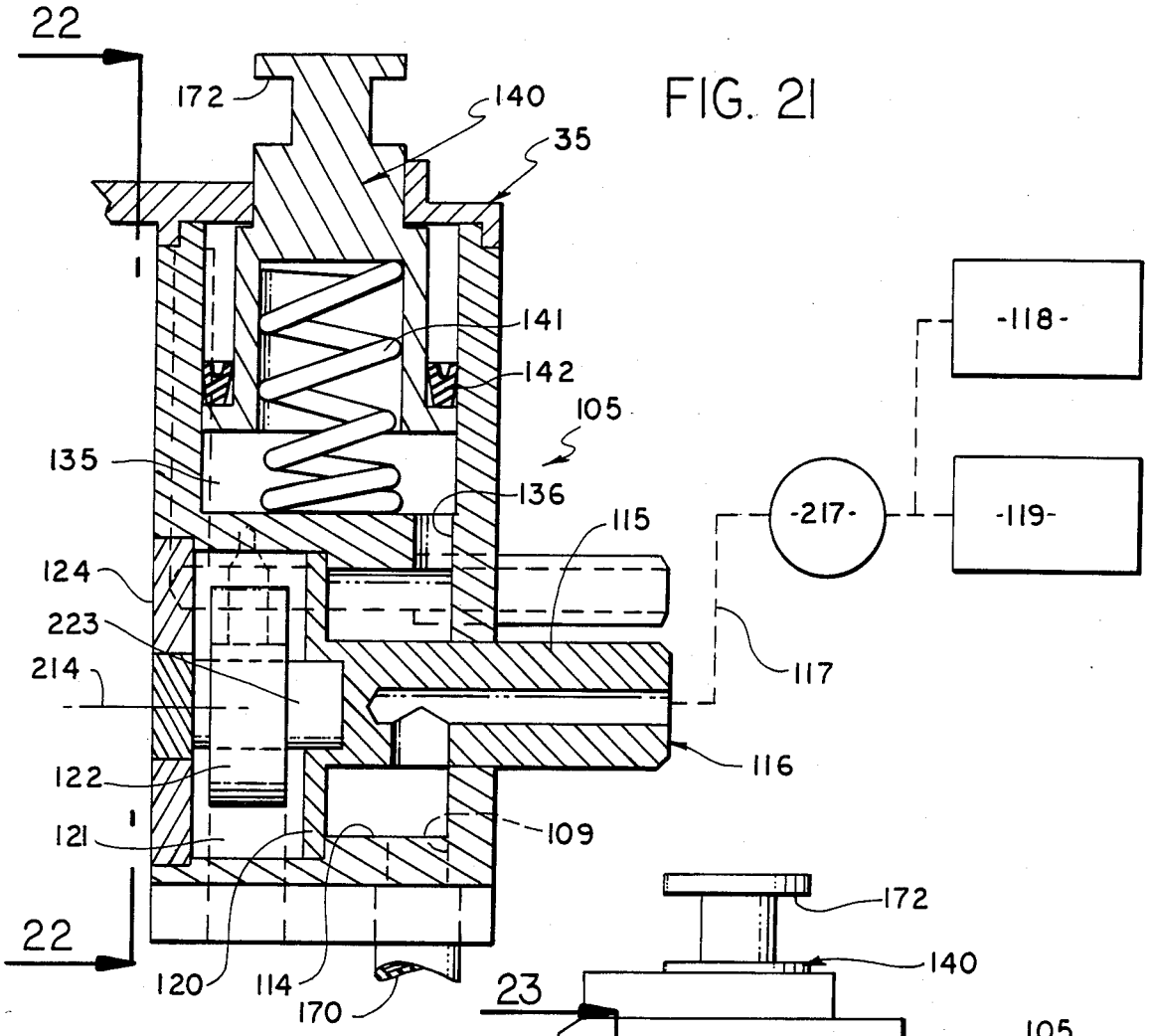
FIG. 21 is an enlarged vertical section taken on line 21—21 of FIG. 2.
Figure 22:
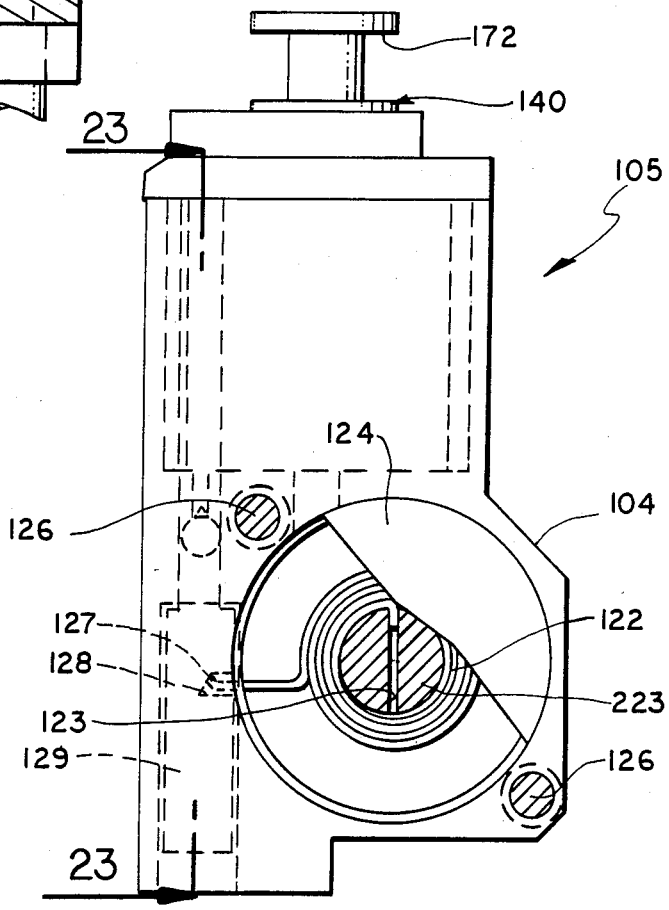
FIG. 22 is a side view taken on line 22—22 of FIG. 21.

The vacuum developed by the engine is communicated from passage 109 in FIG. 21 into an annular chamber 114 formed in block 104 and centered about an axis 214. A tubular portion 115 of a member 116 connected into the block projects outwardly beyond the side of the block and is connected to a hose or other conduit 117, which leads through the PC valve 217 of the engine to the valve cover area 118 and crank case 119. In conventional manner the engine vacuum draws gasoline vapors and heated air from the valve cover area 118 and crank case 119 through the PC valve, with delivery of those heated gases into chamber 114. The heat of these gases as the engine warms up is communicated from chamber 114 to a relatively thin heat conductive metal wall 120 of that chamber, which may be formed from an end portion of part 116 as seen in FIG. 21, with that heat being transmitted through wall 120 to a chamber 121 within which a temperature responsive spiral bi-metal element 122 is received. The center of this bi-metal element is connected into a transverse slot 123 formed in a shaft 223 which is secured rigidly to and projects from a circular cover plate 124 closing the left side of chamber 121. Screw 223 contains a screw driver slot 125 at its outer end by which the shaft and cover 124 and the radially inner extremity of bi-metal element 122 can be rotated to adjust the temperature setting of the device. Cover plate 124 and shaft 223 are adapted to be releasably locked in any desired set position by tightening of two screws 126 which are threadedly connected into block 104 and whose heads are tightenable against the periphery of cover plate 124 at diametrically opposite locations.

The second end 127 of bi-metal element 122 is connected into a recess 128 in a valve member 129 which is slidable upwardly and downwardly within a bore 130 in block 104, and which has an upper tapered valve end 131 adapted to bridge across and close off a vacuum passage 132 in block 104. This passage 132 communicates with the atmosphere through a passage 133 (FIG. 23), whose upper end opens directly to the atmosphere, and whose lower end leads to passage 132 past valve end 131 of member 129. The passage 132 is in communication with engine vacuum at a location to the left of valve element 131 in FIG. 23, preferably through a passage 134 which extends upwardly into a cylinder bore 135, which in turn communicates through a passage 136 with the chamber 114 within which a vacuum produced by the engine is maintained as previously discussed. Thus, when valve element 131 is in its uppermost closed position (broken lines in FIG. 23), passage 132 is maintained under engine vacuum by virtue of its communication through cylinder bore 135 with the main suction passage in the carburetor. The temperature responsive bi-metal element 122 maintains valve 131 in this closed position after the engine has warmed up to a proper operating temperature. Prior to that time, however, when the engine is cold, the temperature responsive element 122 holds member 129 and its upper valve end 131 in an open position (full lines in FIG. 23), in which air can flow directly from the atmosphere through passage 133 into passage 132, and thus atmospheric pressure rather than a vacuum is maintained in passage 132.

The pressure condition within passage 132 is communicated through a tubular fitting 137 and a hose 138 to a connected tubular fitting 139 on the pressure regulator (FIG. 8), to in this way deliver the control vacuum to the regulator. As a result, unless the engine is both in operation and heated, vacuum is not delivered to chamber 102 of the pressure regulator, and the regulator delivers fuel to the carburetor at the higher of its two pressure settings. Stated differently, diaphragm 72 and valve element 88 of the regulator cannot be actuated leftwardly to their FIG. 9 positions, for delivering fuel at a reduced pressure to the carburetor, until the engine has been started, to develop a vacuum within the lower portion of the carburetor, and until the engine has also been heated to a desired operating temperature in which the temperature responsive valve member 131 has been closed off to assure communication of the engine vacuum to the regulator.

In addition to the parts thus far described, block 104 also contains a piston 140 which is exposed at its underside to the vacuum in cylinder chamber 135, and is yieldingly urged upwardly by a coil spring 141, with this piston being sealed by a deformable seal ring 142. Before development of a vacuum within cylinder chamber 135, the piston is maintained in its upper broken line position of FIG. 3 by spring 142, and then as the vacuum develops at the underside of the piston that vacuum is sufficient to pull the piston downwardly against the tendency of the spring and to the full line position of FIG. 3. As will be described at a later point, this downward movement of the piston releases fuel metering valve 29 for increased opening movement.

The fuel metering valve assembly 29 is contained partially within the fuel inlet passage 28 in upper body part 30 (FIG. 3), and partially within an enlarged diameter cylindrical passage 143 in part 30, with both of these passages 28 and 143 being centered about a common horizontal axis 144. The valve assembly includes a tubular member 145 having a reduced diameter portion connected threadedly at 146 into an end of passage 28, and having a flange 147 tightened against a shoulder 148 in body 30 and sealed with respect thereto by an O-ring 149. At its right end as viewed in FIG. 3, member 145 has an annular end surface 150 disposed essentially transversely of axis 144 and forming a seat against which a flexible rubber O-ring 151 is engageable in the fully closed position of the fuel metering valve. A metering rod 152 is elongated along axis 144, and is movable along that axis relative to member 145, and has a metering portion 153 projecting into member 145. This metering portion contains a groove 153*a*, which as seen in FIGS. 6 and 7 is of progressively increasing depth toward the left end of the metering rod as viewed in FIG. 3. The groove 153*a* reaches a point of zero depth at approximately the location of seal ring 151, so that upon movement of the seal ring rightwardly from a position of engagement with its annular seat 150, the groove commences to move slightly to the right of seat 150 to allow the discharge of fuel under pressure past that seat and into the space 154. The engine vacuum draws air inwardly through passage 31 and through the space 154 between the seal ring 151 and seat 150, to receive the fuel and carry it downwardly toward the assembly 32. A plurality of grooves may be provided in rod 152 in lieu of the single groove 153*a* if desired.

Metering rod 152 is carried by a tubular carrier 155, which is disposed about the metering rod and threadedly engages the rod at 156, so that the axial position of the metering rod relative to carrier 155 can be adjusted by rotation of the metering rod. The metering rod is turned by insertion of an allen wrench into an allen wrench recess 157 formed in an enlarged head 158 of the metering rod. This adjustment of the metering rod relative to carrier 155 constitutes an idling mixture adjustment for the carburetor, since it determines what portion of the fuel passing groove 153 of the metering rod 152 is exposed when seal ring 151 is moved slightly away from seat 150. The seal ring may be retained in position by partial reception within an annular groove 159 formed in the interior of the carrier. At its upper side, opposite the lower end of air inlet passage 31, the outer surface of carrier 155 may have a surface 160 which is preferably planar and inclined with respect to axis 144 and with respect to the horizontal, to gradually advance downwardly away from the lower end of opening 31 as the surface 160 advances to the left in FIG. 3. This inclined metering surface essentially closes off the admission of air through passage 31 to the space 154 in the closed position of the metering valve, and gradually opens the lower end of passage 31 to a progressively increasing rate of air inflow from that passage as the carrier 155 and metering rod 152 are moved rightwardly.

Figure 14:
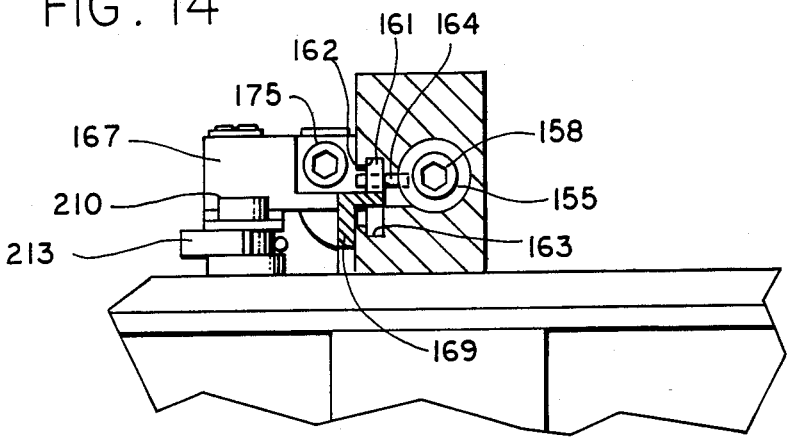
FIG. 14 is a fragmentary vertical section taken on line 14—14 of FIG. 2.

The carrier 155 is actuated axially by the accelerator pedal of the engine through a slide element 161 (FIGS. 4, 5, 13 and 14) which is elongated horizontally parallel to the axis 144 of movement of the metering rod 152, and is guided for longitudinal movement parallel to axis 144 by reception of the upper and lower edges of member 161 within parallel upper and lower guideways 162 and 163 (FIG. 14). A pin 164 rigidly attached to carrier 155 projects horizontally therefrom into a vertical slit or notch 166 formed in slide 161, to thus interlock parts 161 and 155 for horizontal movement parallel to axis 144 in unison.

The actuating force for moving slide 161 and the connected carrier 155 and metering rod 152 axially is applied to slide 161 through an arm 167 (FIGS. 4 and 14) which is rigidly attached to slide 161 and projects horizontally therefrom. Connected to this arm 167 is an override and adjusting mechanism 168 forming an operative connection between the rotary air valve assembly 34 and the linearly movable fuel metering valve 29. The range of permitted axial movement of metering rod 152 is limited in certain conditions of the apparatus by a lever 169 (FIG. 29) which is connected pivotally at 170 to a side of the upper body part 30 in a manner enabling slight pivotal movement of the lever about a horizontal axis 269 relative to the rest of the apparatus and between the full line and broken line positions of FIG. 29. At its right end as viewed in FIGS. 4, 15, 16 and 29, lever 169 has a horizontally projecting portion 171, which is received within an essentially angular groove 172 in the upper end of piston 140, to be actuated downwardly by the previously discussed vacuum induced downward movement of the piston, to thereby pivot the lever in a clockwise direction between the full line position of FIG. 29 and the broken line position of that figure. In addition to the portion 171, the right hand portion of lever 169 has a portion 173 which projects horizontally at a level above portion 171 and to a position in which it can block rightward movement of slide 161 and the connected carrier beyond a predetermined slightly opened position of the metering valve and carrier (full line position in FIG. 3). When the lever 169 is in its full line position of FIG. 29, pin 173 is received opposite the right end of slide 161 to block movement of the slide and carrier and metering rod rightwardly beyond the full line position of FIG. 3. When the right hand portion of lever 169 is swung downwardly to the broken line position of FIG. 29 by downward movement of piston 140, projection 173 is received at a level beneath the lower edge of slide 161, so that the slide is then free to move in a rightward direction as viewed in FIG. 3 to the fully open position of the metering valve. The full line position in which the metering valve is illustrated in FIG. 3 is a position at which the engine operates somewhat above idling speed but far below full speed of the engine. By limiting opening movement of the metering valve, the lever and its projection 173 prevent flooding of the engine by admission of excess fuel to the engine during attempts to start it.

Figure 29:
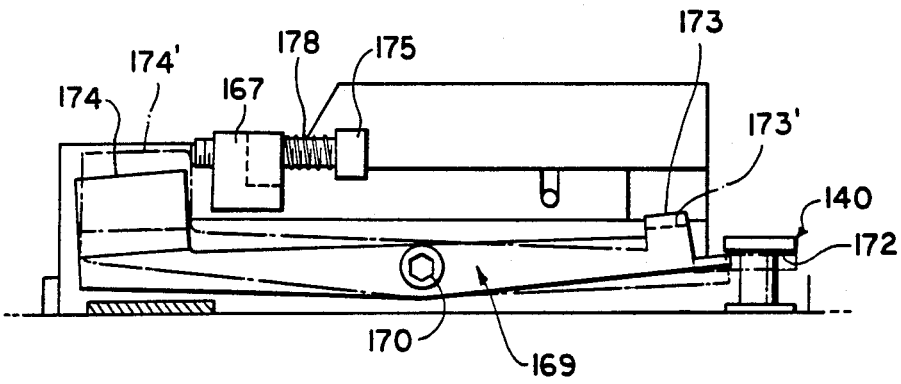
FIG. 29 is a fragmentary view taken on line 29—29 of FIG. 4.

At its left end as viewed in FIGS. 2, 4 and 29, lever 169 rigidly carries an upwardly extending projection 174, which is engageable with an adjustment screw 175 after the engine has been started to limit leftward closing movement of metering rod 152 and the connected parts and thus determine the idle setting of the carburetor. Adjusting screw 175 is threadedly connected to arm 167 attached to slide 161, with the screw 175 being threadedly adjustable horizontally along an axis 177 parallel to axis 144 of the metering valve assembly 29. A spring 178 assists in frictionally retaining screw 175 in any adjusted position relative to arm 167.

Before the engine has been started, projection 174 carried by the left end of lever 169 is in the full line position of FIG. 29, and in that position allows the metering rod 152 to be held by a return spring 179 of the accelerator mechanism in its fully closed position. After the engine has been started and vacuum developed by the engine has resulted in pivotal movement of lever 169 in a clockwise direction to its broken line position of FIG. 29, this pivotal movement causes projection 174 to swing upwardly and slightly rightwardly to the broken line position 174' of FIG. 29, in which position it prevents leftward closing movement of the metering valve as viewed in FIG. 3 beyond the full line position of that figure. Thus, in this idle setting of the mechanism, the seal ring 151 is held slightly away from its seat 151, and a proper amount of fuel for the idle condition is allowed to enter the space 154 from groove 153 of the metering rod 152.

Figure 30:
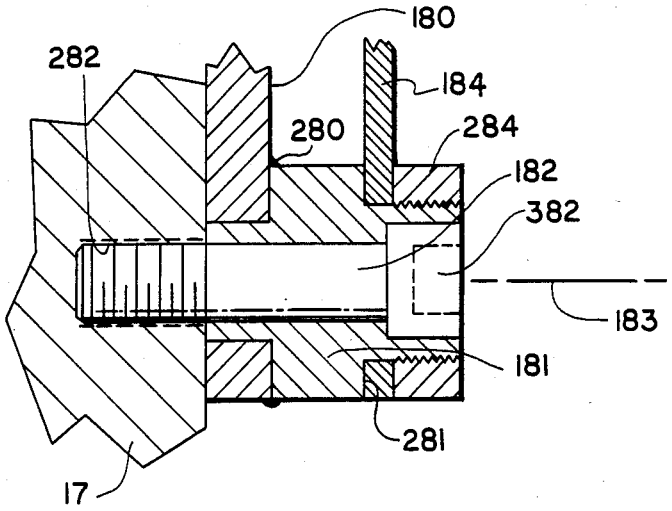
FIG. 30 is an enlarged section on line 30—30 of FIG. 2.

The air and fuel valves are actuated in unison by an arm 180 (FIGS. 2 and 4) which is carried by a hub element 181 mounted by a shaft 182 to turn about a horizontal axis 183 (FIG. 30). The shaft 182 may take the form of a screw connected threadedly at 282 into a side of bottom plate 17 of the carburetor and having a head 382 retaining hub 181 rotatably in position. Arm 180 may be attached rigidly to hub 181, as by welding at 280. A second arm 184 is attached to hub 181, in any desired rotary position relative thereto, by a nut 284 connected threadedly onto element 181 and tightenable against arm 184 to clamp it rigidly between the nut and a shoulder 281 of element 181. Arm 184 is connected to the usual accelerator rod 185 (FIG. 4) to swing arm 184 and the connected arm 180 pivotally about axis 183 in response to longitudinal movement of rod 185 by actuation of the accelerator pedal. Depression of the accelerator pedal acts to pivot arms 184 and 180 in a clockwise direction as viewed in FIG. 2, and the previously mentioned return spring 179 acts to swing arms 180 and 184 back in a counterclockwise direction when the accelerator pedal is released.

Arm 180 contains an elongated slot 186 extending radially with respect to the pivotal axis 183 and within which the threaded end 187 of a member 188 is received. Two nuts 189 and 190 are connected threadedly onto end 187 of member 188 at opposite sides of arm 180, so that when the outer one of these nuts 190 is loosened slightly the member 188 can be shifted along slot 186 to vary its effective radius with respect to axis 183, after which nut 190 can be tightened to clamp arm 180 between the two nuts and rigidly retain member 188 in fixed setting. This adjustment varies the sensitivity of the fuel and air valve actuation with respect to accelerator depression.

Figure 28:
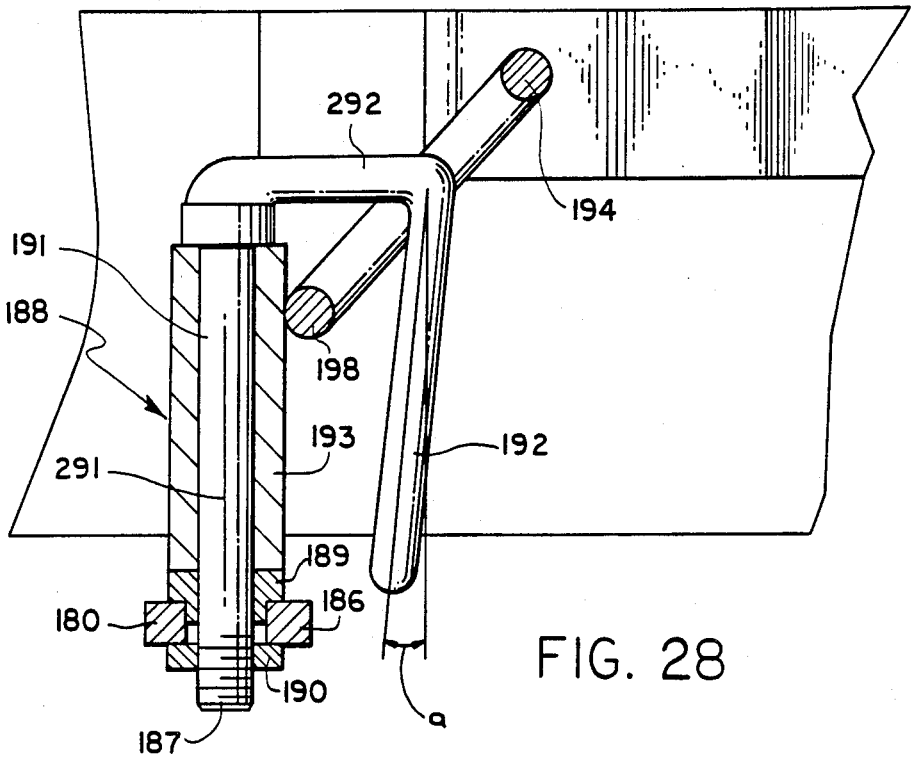
FIG. 28 is a fragmentary horizontal section taken on line 28—28 of FIG. 2.

Member 188 has an elongated cylindrical portion 191 (FIG. 28) which extends horizontally parallel to axis 183, and which carries a second horizontal portion 192 spaced from and generally parallel to portion 191 but preferably converging gradually toward that portion at a slight angle a (desirably 5°). These two portions 191 and 192 are connected rigidly together and may be formed integrally of a single elongated rod or wire having a cross piece portion 292 forming the inner ends of portions 191 and 192. A roller 193 disposed about portion 191 and rotatable about its horizontal longitudinal axis 291 allows transmission of accelerating force to a member 194 connected to the rotary air valve and in a manner avoiding binding of the linkage mechanism.

Figure 17:
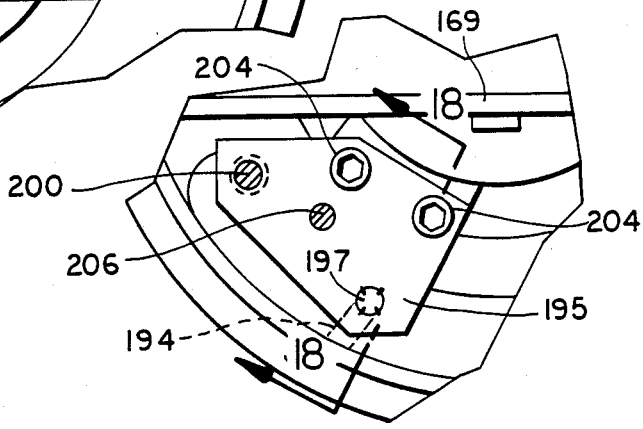
Figure 23:
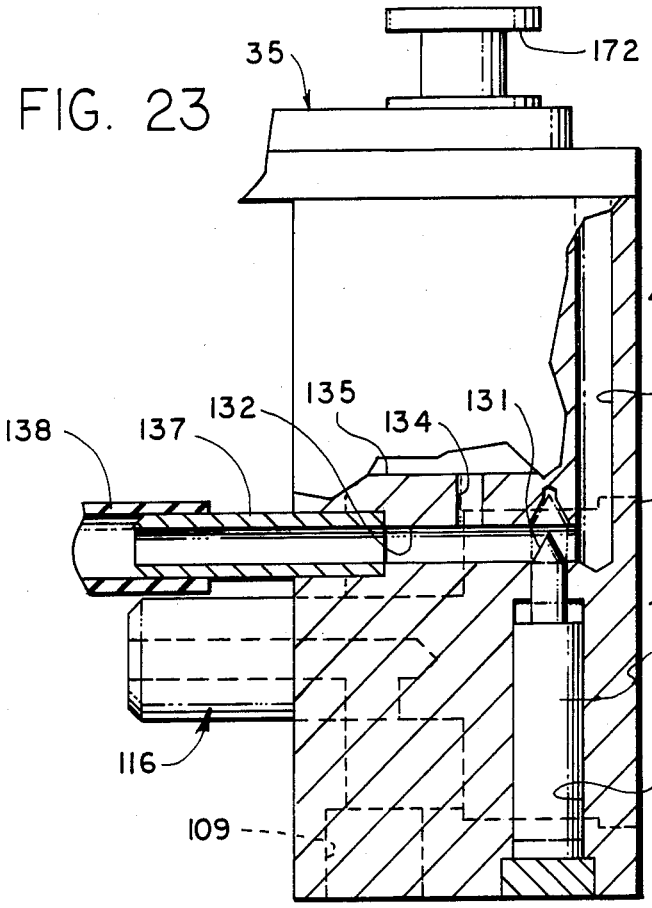
FIG. 23 is a vertical section on line 23—23 of FIG. 22.

Part 194 is carried rigidly by a horizontal plate 195 (FIG. 17), which extends radially with respect to the main vertical axis 24 of the carburetor and is rigidly attached at its radially inner end by two screws 204 to flange or projection 64 of rotary sleeve 61 of the air intake valve assembly 34. Member 194 may be formed as an elongated rod, bent to a U-shaped configuration (FIG. 2) and having one of its vertical arms or portions welded at its upper end 197 to plate 195. The second vertical arm 198 of member 195 is received between portion 192 of member 188 and roller 193 (FIGS. 2 and 28) so that swinging movement of arm 180 and the carried member 188 is communicated to member 194 and the connected air valve sleeve 61 as rotary movement of those parts about vertical axis 24. Portion 196 of member 194 extends vertically through an arcuate slot 294 formed in top plate 35 (FIG. 18) and centered about axis 24, to allow swinging movement of member 194 about that axis, and also extends through and is a close fit within a circular opening 394 in an arcuate horizontal plate 494 which also extends and is movable about axis 24 and acts to close the upper side of slot 294 in all rotary positions of member 194 and the connected parts.

Figure 31:
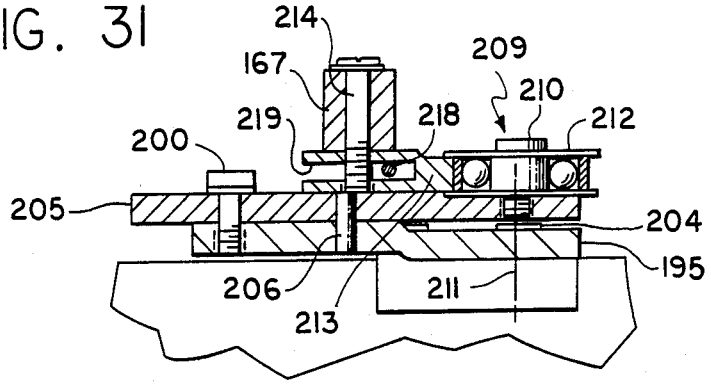
FIG. 31 is an enlarged vertical section taken on 31—31 of FIG. 15.

A mechanism 199 at the upper side of plate 195 activates fuel metering valve rod 152 in correspondence with the opening and closing movement of air valve sleeve 61, and preferably includes a horizontally extending adjusting lever 205 connected to the upper side of plate 195, by a pivot pin 206 (FIG. 16), mounting lever 205 for pivotal movement about a vertical axis 207 relative to plate 195, with that pivotal movement being limited by extension of the shank of a screw 200 downwardly through a slot 208 formed in an end of lever 205 and extending essentially arcuately about axis 207. The screw is connected threadedly to plate 195, with the head of the screw being tightenable downwardly against the lever in any desired pivotal position of the lever to relesably retain it in that setting. At its opposite end, lever 205 rotatably carries a roller 209 (FIG. 31) which is retained by and about the shank of a vertically extending screw 210 threadedly connected at its lower end into plate 195, and with a washer 212 being confined vertically between the head of screw 210 and roller 209 to retain the roller in position. Roller 209 is rotatable about a vertical axis 211 relative to the plate 195.

Figure 32:
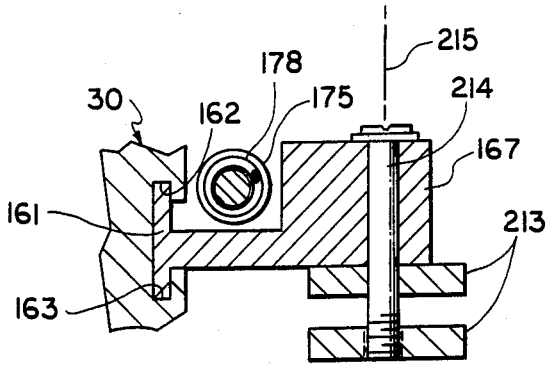
FIG. 32 is an enlarged vertical section taken on line 32—32 of FIG. 2.
Figure 33:
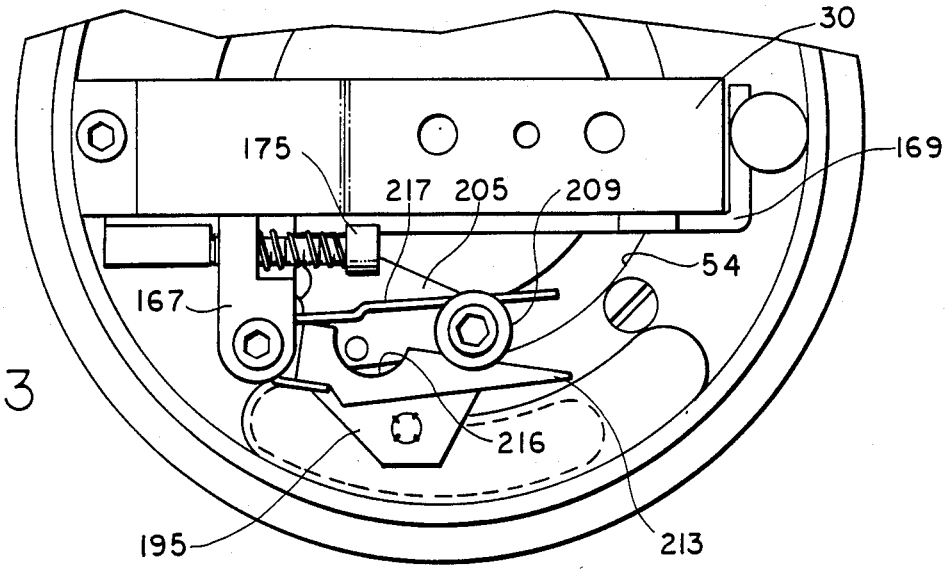
FIG. 33 shows the override mechanism of FIG. 15 in a second position.

Roller 209 and the associated parts form a portion of an override mechanism which also includes a horizontally extending arm 213 connected pivotally to arm 167 projecting from slide 161. This pivotal connection may include a screw 214 (FIG. 32) having a head at the upper side of arm 167 and having a shank projecting downwardly through an opening in arm 167 and connected threadedly at its lower end to arm 213, with the axis 215 of the pivotal connection being vertical. At its outer end, arm 213 contains a partial cylindrical recess or notch 216 (FIGS. 15 and 33) dimensioned to receive and fit closely about cylindrical roller 209 to transmit motion thereto. A spring 217 may have a first end 218 confined within a recess 219 in the inner portion of arm 213, and may form a coil 220 from which a second end portion 221 extends to a location opposite notch 218 and arm 213. The spring bears yieldingly against the roller in a manner confining the roller between the spring and the wall of notch 216. When the parts are connected in this manner, arm 213 will by virtue of its engagement with roller 209 cause linear opening movement of fuel metering rod 152 in response to and in correspondence with the rotary opening movement of the air valve sleeve 61. However, if the lever 169 is in its full line position of FIG. 29, in which it retains the metering rod against rightward movement beyond a predetermined position corresponding to a speed slightly above idling speed, such retention of the fuel metering valve against further movement does not prevent forced continued opening movement of the air valve by the accelerator pedal. If the operator actuates the accelerator pedal forcibly beyond the position at which further opening movement of the fuel valve is possible, the portion 221 of spring 217 can yield in the manner illustrated in FIG. 33, with the movement of that portion of the spring away from arm 213 caused by movement of roller 209 out of the notch 216. The camming effect of the engaging cylindrical surfaces of the roller and notch cause this displacement of the roller out of the notch against the tendency of the spring, so that the air valve can be opened completely without corresponding full opening movement of the fuel valve, to thereby allow effective purging of the carburetor and engine with air and positively prevent flooding of the engine by excess fuel under any circumstances. In addition to this automatic override feature permitting opening of the air valve without corresponding full opening movement of the fuel valve, the linkage 199 interconnecting the air and fuel valves can be adjusted by pivotal movement of the lever 205 with respect to arm 203 to move the vertical axis 211 of roller 209 slightly inwardly or outwardly relative to the main rotary axis 24 of the air valve, with this adjustment functioning as a high speed adjustment of the air fuel ratio.

The assembly 32 directing the fuel and some of the air along paths causing full vaporization and dispersal of the fuel in the air includes an essentially circular part 222 having an upper externally threaded portion connected threadedly into a vertically extending passage in upper body part 30 at 223, and having an enlarged circular head 224 with an upper horizontal surface 225 bearing upwardly and annularly against a horizontal undersurface 226 of plate 35. An annular member 227 is confined vertically between head 224 and plate 235, as shown. Internally, the upper threaded portion of member 222 contains a downwardly tapering frustoconical passage 228 centered about vertical axis 24 of the carburetor, and having a diameter which progressively decreases to a location 229 at which a series of circularly spaced passages 230 (FIG. 24) extend radially outwardly from this minimum diameter portion of the air and fuel passage 228 to the location of an annular groove 231 formed in the underside of upper body part 30. Groove 231 receives air from the spaces at opposite sides of upper body 30 through passages 213' (FIG. 5) formed in body 30. This air is drawn by engine vacuum into groove 231 and then radially inwardly through passages 230 to meet and mix with the intermixed fuel and gas from passage 228 at the minimum diameter portion of that passage, at which the intermixed fuel and air have maximum velocity. The addition of inwardly moving air to the downwardly moving mixture thus enhances the atomization and vaporization of the fuel.

As the resulting mixture moves downwardly through a preferably uniform diameter lower extension 232 of passage 228, it approaches the location of a series of circularly spaced generally radially extending passages 233 in member 222, which lead the air outwardly to an annular space 234 between the ring 227 and plate 35. As seen in FIG. 25, the ring contains a series of evenly circularly spaced passages 235 which taper downwardly and preferably frustoconically, and which are centered about a series of vertically extending axes 236 parallel to main axis 24 and spaced evenly thereabout. At the minimum diameter lower ends of these passages 235, at which the air-fuel mixture is traveling at maximum velocity, additional air is introduced into each of the streams of intermixed air and fuel from an annular gap 237 formed vertically between ring 227 and an upper surface 238 of head 224. The air enters this gap from an annular space 239 radially outwardly of the ring, and enters that space through a number of circularly spaced openings 240 extending downwardly through plate 35 at locations offset from body part 30 (FIG. 5). The upper ends of these openings are in communication with the interior of the air filter, to receive air therefrom. Downwardly beneath the air introduction space 237, head 224 contains passages 33, which are aligned vertically with corresponding ones of the passages 235, being centered about the same axes 236 as these passages 235, to receive the intermixed fuel and air and deliver it downwardly into the interior of air valve 34. Passages 33 may flare to progressively increased diameters in frustoconical fashion as illustrated. After all of the streams leave the various passages 33, they flow downwardly together within the interior of air valve 34, and are intermixed with additional air flowing inwardly through the apertures of that valve assembly to ultimately discharge downwardly from the lower end of the carburetor into the intake manifold structure 13.

Figure 34:
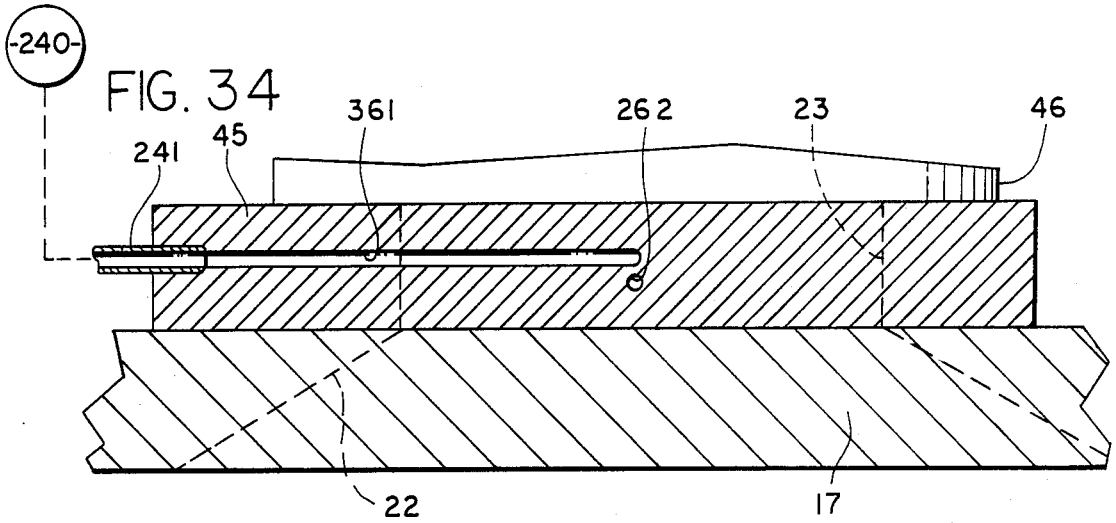
FIG. 34 is a vertical section on line 34—34 of FIG. 27.

The engine vacuum is delivered from the present carburetor to the spark advance fitting of the engine distributor 240 (FIG. 34) through a fitting 241 projecting from member 45 of the carburetor. The delivery of engine vacuum to the distributor is automatically closed off at idle by a valve element 242 (FIG. 27) carried by a member 243 having a cam member 244 attached rigidly to its upper side and adapted to be engaged by the lower horizontal portion 45 of element 194 (see FIG. 2). The member 243 is a generally horizontally elongated element connected pivotally to member 45 at 246 for limited upward and downward swinging movement about a horizontal axis 247 between the full line position of FIG. 2 and a slightly depressed broken line position represented at 243'. A spring 248 received within opposed recesses in members 17 and 243 yieldingly urges the member 243 upwardly to its full line position of FIG. 2. Cam member 244 may be secured to the upper side of member 243 in any appropriate manner, as by a screw represented at 249. The cam member has an upper camming surface 250 with an inclined portion 251 near its left end adapted to be engaged by the undersurface of the lower portion of member 196 as that member moves rightwardly in FIG. 2, to thereby deflect member 243 downwardly. After such deflection, the portion 252 of the upper surface 250 of cam member 244 which is rightwardly beyond the inclined portion 251 is disposed substantially horizontally, so that further rightward movement of member 196 does not deflect member 243 downwardly to any increased extent, but merely maintains the member in the broken line position 243'.

Referring now to FIG. 27, the valving element 242 is circular and received within a cylindrical recess 254 formed in the inner side of member 243 and centered about a horizontal axis 255, with a shank 256 of the valve element being slidably received within a passage 257 in member 243 to guide the valve element for movement along axis 255. A spring 258 yieldingly urges valve element 242 leftwardly in FIG. 27, maintaining an annular planar vertical surface 259 of element 242 in engagement with a vertical planar side surface 260 of member 45. A circular recess 261 formed in element 242 within surface 259 communicates with a passage 361 formed in member 45 and leading to the previously mentioned fitting 241 connected to the spark advance of distributor 240. A second passage 262 in member 45 communicates with recess 261 in the valve element in the lower position of that valve element and member 243 (broken lines in FIG. 2), but is located opposite a portion of surface 259 and in the upper position of the valve element in member 243 (full lines in FIG. 2) to close off communication between passages 262 and 361 in the upper position of the valve element. The inner end of passage 262 is in communication with engine vacuum through the previously mentioned annular chamber 108 in member 45.

When the engine is operating at idle speed, the member 243 is in its full line position of FIG. 2, and the valve element 242 is in its full line position of FIG. 27 in which engine vacuum is not communicated to the spark advance, and the spark of the engine is therefore not in advance condition. When the speed of the engine is increased to a value above idle, member 194 moves rightwardly in FIG. 2 far enough to deflect member 243 downwardly to its broken line position of FIG. 2, in which the valve element is moved downwardly in FIG. 27 far enough to place passage 262 in communication with passage 361 through recess 261 and thereby communicate engine vacuum to the spark advance fitting 241.

To discuss a cycle of operation of the carburetor, assume that the device has been mounted on the intake manifold of an engine in the condition illustrated in FIG. 1, with air cleaner 12 connected to the upper side of the carburetor, and further assume that the engine is initially cold and not in operation. In this condition, the fuel metering valve 152 and the carrier 155 to which it is connected are actuated (leftwardly in FIG. 3) to a position in which seal ring 151 is in engagement with surface 150 at the end of member 145 to positively close off all fuel flow into the air stream. Further, the upper surface 160 of carrier 155 is in this condition located to the left of passage 31, so that the carrier prevents the entry of substantial air through passage 31. Like the fuel valve, air valve 34 is similarly closed to prevent the admission of air radially inwardly through assembly 34 into passage 23. Piston 140 is in its upper position, and the temperature responsive element 122 is in a condition holding valve 131 in its open position.

As the starter of the engine is energized to turn the engine over, fuel pump 25 delivers fuel to pressure regulator 27 which in turn delivers fuel at a regulated pressure to passage 28 at the inlet side of fuel metering valve 29. The slowly turning engine when driven by the starter develops some vacuum in the lower portion of passage 23 in the carburetor, to tend to draw air into the various air inlets of the carburetor, but the vacuum is not great enough to bias diaphragm 73 of the pressure regulator leftwardly in FIG. 8, and thus element 88 is held in a position to produce a fairly high pressure at the metering valve. The operator must press the accelerator to swing arm 180 in a clockwise direction as viewed in FIG. 2, and correspondingly open air valve assembly 34 slightly by action of roller 193 carried by arm 180 against member 194, which in turn swings plate 195 connected to valve sleeve 34 pivotally about axis 24 in a valve opening direction. This rotary actuation of plate 195 also acts through lever 205, roller 209, arm 213, and arm 167 to move slide 161 rightwardly in FIG. 2, and thus shift the connected carrier 155 and fuel metering rod 152 rightwardly, with resultant movement of seal ring 151 away from surface 150 and slight opening movement of the fuel valve. The same movement opens the lower end of passage 31 a corresponding amount, to allow the engine vacuum to draw air inwardly through passage 31 and past the exposed portion of groove 153 of the metering rod, to draw the fuel downwardly into passage 228 and the other fuel dispersal passages in part 222 and ring 227. During starting, the vacuum developed in the engine is not great enough to pull piston 140 downwardly, and consequently the connected lever 169 is in its full line position of FIG. 29 in which projection 173 limits rightward movement of the metering rod in the full line position of FIG. 3. However, as previously discussed, the air valve can be forcibly moved to its fully opened position by virtue of the override mechanism (see FIG. 33), to purge the carburetor and engine of excess fuel if necessary. As the air and fuel flow through the circuitous passages in and associated with member 224, with introduction of air at the high velocity locations defined by the minimum diameter portions of the converging passages 228 and 235, the result is full vaporization of the fuel and uniform dispersal of the fuel within the air. This highly effective air fuel mixture can then flow downwardly into the intake manifold for quick starting of the engine.

After the engine has been started and is in operation, the pistons will develop in the lower portion of passage 23 of the carburetor a much higher vacuum, which is sufficient to pull piston 140 downwardly and thus pivot lever 169 to its broken line position of FIG. 29, in which it allows full opening movement of the fuel metering valve and also prevents leftward movement of the metering valve to a fully closed position by virtue of engagement of the projection 174 with adjusting screw 175. If the accelerator is then released, engagement of screw 175 with projection 174 defines the idle setting (full line position of FIG. 3) in which just sufficient fuel is allowed to enter the carburetor through metering valve 29 to maintain the engine in operation at slow speed.

The operating vacuum which is developed within chamber 135 at the underside of piston 140 is communicated through passage 134 to passage 132, but that passage is initially vented to the atmosphere past valve element 129–131, to prevent transmission of the vacuum to the right side of diaphragm 73 of the pressure regulator. Consequently, the regulator continues to maintain the fuel pressure at the inlet side of the fuel metering valve at a relatively high starting value. Passage 134 is sufficiently restricted to prevent the atmospheric pressure in passages 133 and 132 from relieving the vacuum in cylinder chamber 135 to any substantial extent. Thus, the vacuum in chamber 135 is high enough to maintain piston 140 in its lower position even though essentially atmospheric pressure is maintained in passage 132.

As the engine warms up, the rise in temperature is communicated to chamber 114 in block 104 by vacuum induced flow of heated gases from under the valve cover at 118 and from the crank case 119 through PC valve 117, to ultimately cause temperature responsive element 122 to close valve element 131 blocking off communication between the atmosphere and passage 132, and thereby communicating the engine vacuum through hose 138 to the left side of diaphragm 73 in the pressure regulator. This actuates diaphragm 73 leftwardly against the resistance of spring 96, relieving the force applied by spring 96 on spring 94, and thereby shifting valve element 88 leftwardly from its position of FIG. 8 to its position of FIG. 9, to thereafter maintain a regulated lower fuel pressure at the inlet side of fuel metering valve 29. This actuation of the pressure regulator automatically reduces the proportion of fuel in the fuel air mixture delivered to the engine.

In adjusting the carburetor for optimum operation of the engine, screw 175 is adjusted to determine the idle setting of the engine, metering valve 152 is threadedly adjusted relative to carrier 155 to determine the proportions of air and fuel at idle, and lever 205 is adjusted pivotally relative to plate 195 to determine the air fuel mixture at high speed. Also, screw 113 is adjusted to shift ring 112 to a position setting the proportions of air flowing through passages 110 and 111 to a condition diverting the main flow of intermixed fuel and air slightly laterally to direct more of the air through intake manifold passage 14 than passage 15, or vice-a-versa, and to do so to exactly the correct extent for delivering proper amounts of fuel air mixture to the two sets of cylinders.

Figure 35:
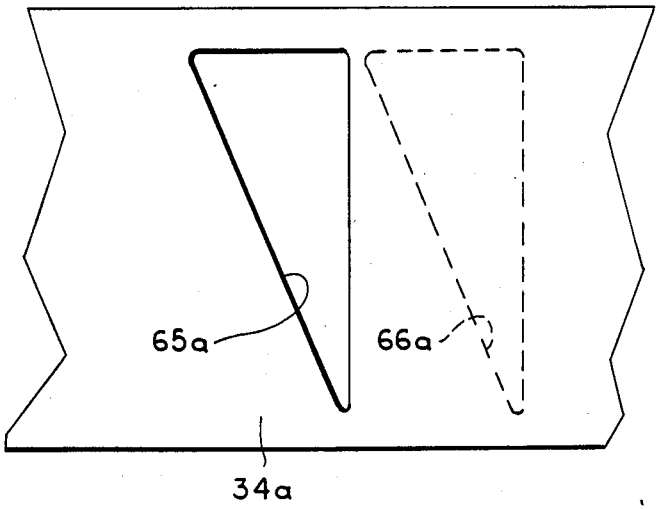
FIG. 35 is a view similar to FIG. 20, but showing an air valve assembly having apertures of a different configuration.

FIG. 35 is a view similar to FIG. 20, but shows an arrangement in which the air passing apertures in the two sleeves of the air valve assembly 34*a* have different configurations than in FIG. 20. More particularly, the apertures 65*a* and 66*a* corresponding to apertures 65 and 66 of the first form of the invention and formed in sleeves 47*a* and 61*a* (corresponding to sleeves 47 and 61) may have their maximum width portions at the upper extremities of the sleeves rather than at vertically intermediate locations as in FIG. 20 and the other related figures. Other aperture configurations can of course be employed. Except with regard to the shapes of the apertures, the operation of the carburetor of FIG. 35 may be the same as discussed in connection with the first form of the invention.

While certain specific embodiments of the present invention have been disclosed as typical, the invention is of course not limited to these particular forms, but rather is applicable broadly to all such variations as fall within the scope of the appended claims.

We claim:

1. A carburetor comprising:

a housing structure;

a fuel metering valve for delivering fuel at a controllably variable rate to flow along a predetermined path or paths within said housing structure for delivery to an engine, and including a metering element movable to progressively increase the rate of fuel delivery;

a pressure regulator controlling the pressure of fuel delivered to said metering valve;

a first air inlet for introducing air at a location to intermix with fuel from said metering valve;

means downstream of said fuel metering valve and said first air inlet for directing the intermixed air and fuel along a non linear path or paths of abruptly changing direction;

additional air inlet means for introducing air into said fuel metering valve and at a location or locations along said non linear path or paths;

an essentially tubular air valve through which said intermixed air and fuel flows downstream of said non linear path or paths and comprising valve sleeves disposed one about the other and containing wall apertures movable into and out of registry to progressively regulate the admission of additional air laterally into the flow of intermixed fuel and air; and linkage connecting said fuel metering valve and said air valve together for actuation in unison.

2. A carburetor comprising:

a housing structure;

a fuel metering valve for introducing fuel to said housing structure at a location to mix with air for delivery to an engine;

said metering valve including a valve element movable in a predetermined direction to increase the rate of delivery of fuel through the valve for acceleration of the engine;

means for limiting opening movement of said valve element in said predetermined direction during starting of the engine; and additional means automatically responsive to an increase in engine vacuum to release said first mentioned means and permit increased opening movement of said valve element after the engine has been started.

3. A carburetor as recited in claim 2, in which said additional means include a piston actuable by engine vacuum to release said first mentioned means.

4. A carburetor as recited in claim 2, in which said first mentioned means include a member movable between a first position in which said member prevents opening movement of said valve element beyond a predetermined setting and a second position permitting increased opening movement of the valve element, said additional means including a vacuum operated unit subjected to engine vacuum and operable to displace said member from said first position to said second position upon an increase in engine vacuum.

5. A carburetor as recited in claim 2, in which said additional means include a piston movable within a cylinder and exposed to engine vacuum and operable by said vacuum to release said first mentioned means for enabling increased opening movement of said valve element, a pressure regulator for regulating the pressure of fuel delivered to said metering valve, vacuum responsive means for automatically adjusting said regulator to vary the pressure of fuel at said metering valve in response to changes in engine vacuum, a passage for delivering engine vacuum to said vacuum responsive means, an additional valve member operable between an open position in which it places said passage in communication with atmosphere to break the vacuum at said vacuum responsive means and a closed position permitting communication of engine vacuum to said vacuum responsive means, a temperature responsive element operable upon an increase in temperature to close said additional valve member, and means for delivering heated gases to a location near said temperature responsive element.

6. A carburetor as recited in claim 2, in which said first mentioned means includes a lever carrying a projection adapted to block opening movement of said metering valve, and means mounting the lever for swinging movement between a position in which said projection blocks opening movement of said metering valve and a position permitting opening movement of the metering valve.

7. A carburetor as recited in claim 2, including a structure connected operatively to said first mentioned means for movement to a position limiting retracting movement of said valve element in a closing direction when said first mentioned means are released to permit said increased opening movement of the valve element.

8. A carburetor as recited in claim 2, in which said first mentioned means include a lever, and a stop element carried by the lever for swinging movement therewith and acting to limit opening movement of said valve element, there being a second stop element carried by and swinging with the lever and actuable to a position limiting closing movement of said valve element upon movement of said first stop element to a position allowing increased opening movement of the valve element.

9. A carburetor as recited in claim 2, including a carrier for actuating said valve element in said predetermined direction, and a threaded connection between said valve element and said carrier for adjusting the relative axial setting thereof.

10. A carburetor comprising:

a housing structure having an outlet through which a mixture of fuel and air flows for delivery to two intake manifold passages of an engine;

means for introducing fuel and air into said housing structure for intermixture and flow through said outlet to said manifold passages;

two air inlets at different sides of said outlet for introducing two streams of additional air to flow into the manifold passages with the intermixed fuel and air; and valve means for adjusting the amount of air flowing through one of said air inlets as compared with the amount of air flowing through the other of said air inlets to correspondingly regulate the flow of fuel and air into one of said manifold passages as compared with the other manifold passage.

11. A carburetor as recited in claim 10, in which said valve means include a ring having portions adapted to at least partially block the flow of air through said two air inlets and which is bodily shiftable to increase the rate of flow through one inlet and decrease the rate of flow through the other inlet.

12. A carburetor as recited in claim 11, including a threaded fastener for adjustably shifting said ring relative to said two air inlets.

13. A carburetor comprising:

a fuel metering valve including a first valve element movable linearly along a first axis to vary the rate of delivery of fuel to a flow of air for mixture therewith;

an air valve including a second valve element movable rotatively about a second axis to vary the rate of air flow;

a lever connected to said second valve element for rotary movement therewith about said second axis and for pivotal movement relative thereto about a third axis extending essentially parallel to said second axis;

a connection between said lever and said first valve element for converting rotary motion of said second valve element and said lever about said second axis to linear movement of said first valve element along said first axis, and which connection is movable toward and away from said second axis by pivotal movement of said lever to vary the amount of linear movement of said first element upon a predetermined amount of rotary movemet of said second element about said second axis; and means for releasably retaining said lever in different pivotal positions about said third axis.

14. A carburetor as recited in claim 13, including means operable in one condition to limit linear opening movement of said first valve element.

15. A carburetor as recited in claim 13, including means operable in one condition to limit linear opening movement of said first valve element; said connection including an override mechanism between said lever and said linearly movable first valve element adapted to enable forced movement of said second valve element and lever about said first axis without corresponding linear movement of said first valve element when the first valve element is retained against movement by said last mentioned means.

16. A carburetor as recited in claim 15, in which said override mechanism includes a roller carried by said lever at a location offset from said third axis, and a spring urged arm connected pivotally to said first valve element for movement therewith and containing a recess receiving said roller and adapted to be forced out of engagement with the roller to enable opening movement of said second valve element without corresponding opening movement of said first valve element.

17. A carburetor comprising:

a housing structure;

a fuel inlet delivering liquid fuel at a location to flow along a path or paths within said housing structure and toward an outlet;

first air inlet means for delivering a flow of air to said fuel from said fuel inlet to intermix therewith and flow along said path or paths therewith;

second air inlet means for delivering additional air to said intermixed fuel and air from said fuel inlet and said first air inlet means at a location downstream of said fuel inlet and said first air inlet means;

said fuel inlet having a metering valve including a sleeve and a metering element of progressively decreasing effective cross section movable axially relative to said sleeve;

a carrier for actuating said metering element and threadedly connected thereto for adjustment of the metering element;

means for actuating said carrier and thereby said metering element axially relative to said sleeve; and a seal element carried by said carrier and movable axially therewith and engageable with a seat to close off all delivery of fuel from the fuel inlet;

said first air inlet means delivering air to a location adjacent said carrier;

said carrier having a portion of progressively changing cross section operable to progressively increase the delivery of air through said first air inlet means upon movement of the carrier and metering element in a direction to increase the rate of fuel delivery through the metering valve.

18. A carburetor comprising:

a housing structure;

a fuel inlet delivering liquid fuel at a location to flow along a path or paths within said housing structure and toward an outlet;

first air inlet means for delivering a flow of air to said fuel from said fuel inlet to intermix therewith and flow along said path or paths therewith;

second air inlet means for delivering additional air to said intermixed fuel and air from said fuel inlet and said first air inlet means at a location downstream of said fuel inlet and said first air inlet means;

said fuel inlet including a fuel metering valve having a sleeve through which the fuel is delivered, and having a metering rod which projects into the sleeve and is movable axially relative thereto and has a portion of progressively decreasing effective cross section to progressively increase the rate of fuel delivery in response to aixial movement of the metering rod in a predetermined direction;

a carrier disposed about said metering rod for actuating it;

means for moving said carrier axially to increase and decrease the rate of fuel delivery;

a threaded connection between said metering rod and said carrier for adjusting the rod relative to the carrier;

a deformable seal ring carried by the carrier about said rod; and a seat carried by said sleeve and engageable by said seal ring to close off delivery of the fuel in a fully closed position of the rod and the carrier;

said first air inlet means including a passage delivering air to a location adjacent the exterior of said carrier to flow past the carrier and past said metering valve;

said carrier having a tapering outer surface opposite said passage operable to progressively increase the rate of air flow through said passage upon axial movement of the carrier away from said seat.

19. A carburetor comprising:

a housing structure;

a fuel inlet delivering liquid fuel at a location to flow along a path or paths within said housing structures and toward an outlet;

first air inlet means for delivering a flow of air to said fuel from said fuel inlet to intermix therewith and flow along said path or paths therewith;

second air inlet means for delivering additional air to said intermixed fuel and air from said fuel inlet and said first air inlet means at a location downstream of said fuel inlet and said first air inlet means;

means forming a first tapering passage of progressively decreasing cross section through which the intermixed fuel and air from said fuel inlet and said first air inlet means flow to increase the velocity thereof;

said second air inlet means being positioned to deliver said additional air to said intermixed fuel and air from said fuel inlet and said first air inlet means at essentially the downstream end of said tapering passage for intermixture with the fuel and air while they are travelling at high velocity;

at least one additional tapering passage through which the intermixed fuel and air are delivered downstream of said second air inlet means; and third air inlet means for introducing air to the intermixed fuel and air essentially downstream of said additional tapering passage.

20. A carbueretor comprising:

a housing structure;

a fuel inlet delivering liquid fuel at a location to flow along a path or paths within said housing structure and toward an outlet;

first air inlet means for delivering a flow of air to said fuel from said fuel inlet to intermix therewith and flow along said path or paths therewith;

second air inlet means for delivering additional air to said intermixed fuel and air from said fuel inlet and said first air inlet means at a location downstream of said fuel inlet and said first air inlet means;

a tapering passage downstream of said fuel inlet and said first air inlet means through which the intermixed fuel and air are directed to increase in velocity;

said second air inlet means including a plurality of air passages extending generally radially inwardly for introducing air near the downstream end of said tapering passage;

a plurality of passages downstream of said second air inlet means directing intermixed air and fuel generally radially outwardly;

a plurality of additional tapering passages at circularly spaced locations receiving air and fuel from said last mentioned passages for flow through said additional tapering passages at progressively increasing velocity; and third air inlet means delivering additional air to the intermixed air and fuel near the downsream end of said additional tapering passages for intermixture therewith.

21. A carburetor as recited in claim 20, including flaring passages of progressively increasing cross section through which the intermixed fuel and air flow downstream of said third air inlet means.

22. A carburetor as recited in claim 21, including fourth air inlet means comprising two concentric tubular sleeves disposed about and defining a passage through which intermixed air and fuel flow downstream of said flaring passages, said sleeves containing aperture relatively movable between positions of varying effective cross section by rotation of one of said sleeves relative to the other.

23. A carburetor as recited in claim 22, including a metering valve for regulating the admission of fuel through said fuel inlet, and mechanism for opening and closing said metering valve and rotating said one sleeve essentially in unison.

24. A carburetor comprising:

a housing structure;

a fuel inlet delivering liquid fuel at a location to flow along a path or paths within said housing structure and toward and outlet;

first air inlet means for delivering a flow of air to said fuel from said fuel inlet to intermix therewith and flow along said path or paths therewith;

second air inlet means for delivering additional air to said intermixed fuel and air from said fuel inlet and said first air inlet means at a location downstream of said fuel inlet and said first air inlet means;

said second air inlet means including a tubular air valve structure including two concentric sleeves disposed one about the other and which are relatively rotatable and which contains side wall apertures communicating with one another and movable to positions of varying registry to varying the rate of air delivery laterally into said sleeves for intermixtures with the fuel and air from said fuel inlet and said first air inlet means.

25. A carburetor as recited in claim 24, in which said side wall apratures in said sleeves are of similar essentially triangular configuration.

26. A carbueretor comprising:

a housing structure;

a fuel inlet delivering liquid fuel at a location to flow along a path or paths within said housing structure and toward an outlet;

first air inlet means for delivering a flow of air to said fuel from said fuel inlet to intermix therewith and flow along said path or paths therewith;

second air inlet means for delivering additional air to said intermixed fuel and air from said fuel inlet and said first air inlet means at a location downstream of said fuel inlet and said first air inlet means;

said fuel inlet having a metering valve including a metering rod movable axially relative to and within a sleeve;

said second air inlet means having an essentially tubular valve structure including two sleeves through which intermixed fuel and air flow and containing apertures movable into and out of registry by relative rotation of the sleeves to vary the rate of inflow of said additional air; and an accelerator mechanism for actuating said metering rod and one of said sleeves essentially in correspondence with one another.

27. A carburetor comprising:

a housing structure;

a fuel inlet delivering liquid fuel at a location to flow along a path or paths within said housing structure and toward an outlet;

first air inlet means for delivering a flow of air to said fuel from said fuel inlet to intermix therewith and flow along said path or paths therewith;

second air inlet means for delivering additional air to said intermixed fuel and air from said fuel inlet and said first air inlet means at a location downstream of said fuel inlet and said first air inlet means;

said fuel inlet having a fuel metering valve actuable to vary the rate of fuel delivery;

said second air inlet means having an air inlet valve for regulating the admission of said additional air;

means for preventing full opening movement of said fuel metering valve during starting of an engine to which the carburetor delivers an air fuel mixture; and a lindage for actuating said fuel and air valves essentially in unison with one another and including an override mechanism enabling opening of said air inlet valve without corresponding opening movement of said fuel metering valve when the latter is retained aganist full opening movement;

said override mechanism including an element for actuating one of said valves, and a spring urged arm movable upon opening of the other valve and containing a recess receiving said element for actuating the element in a valve opening direction but adapted to move out of driving engagement with said elemcnt upon imposition of valve opening force when the fuel metering valve is retained against opening movement.

28. A carburetor comprising:

a metering valve having an elongated valve element movable longitudinally along a predetermined axis to vary the rate of delivery of fuel for admixture with a flow of air;

a carrier disposed about said valve element and connected threadedly thereto for adjustment of the position of said valve element relative to the carrier;

accelarator controlled mechanism for actuating said carrier along said axis to open and close the connected valve element;

said mechanism including a slide located at a side of said carrier and guided for movement parallel to said axis, and a connection extending laterally between said slide and said carrier for transmitting motion therebetween; and a lever mounted for pivotal movement near said slide and having a portion acting in a first pivotal position of the lever to limit movement of the slide in a valve opening direction;

said portion of the lever being retracted to permit increased valve opening movement of said slide in a second pivotal position of the lever.

29. A carburetor as recited in claim 28, including means actuable by vacuum to which the carburetor is subjected to pivot said lever between said first and second positions.

30. A carburetor as recited in claim 28, including means carried by said lever for limiting retracting movement of said slide and the connected carrier and valve element in a valve closing direction in said second pivotal position of the lever.

* * * * *